US008445168B2

(12) United States Patent
Akiyama et al.

(10) Patent No.: US 8,445,168 B2
(45) Date of Patent: May 21, 2013

(54) ELECTROPHOTOGRAPHIC PHOTOSENSITIVE MEMBER AND ELECTROPHOTOGRAPHIC APPARATUS

(75) Inventors: Kazuyoshi Akiyama, Mishima (JP); Tomohito Ozawa, Mishima (JP); Daisuke Tazawa, Yokohama (JP); Yuu Nishimura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 12/949,015

(22) Filed: Nov. 18, 2010

(65) Prior Publication Data

US 2011/0123914 A1 May 26, 2011

(30) Foreign Application Priority Data

Nov. 26, 2009 (JP) ..... 2009-269345
Nov. 12, 2010 (JP) ..... 2010-253635

(51) Int. Cl.
*G03G 5/04* (2006.01)

(52) U.S. Cl.
USPC ..... 430/59.1; 430/56; 430/66

(58) Field of Classification Search ..... 430/58.85–59.6
See application file for complete search history.

(56) References Cited

U.S. PATENT DOCUMENTS 4,555,464 A 11/1985 Kido et al.
4,559,289 A 12/1985 Sunagawa et al.
4,569,855 A 2/1986 Matsuda et al.
4,659,639 A 4/1987 Mizuno et al.
4,683,144 A 7/1987 Nishimura et al.
4,683,145 A 7/1987 Nishimura et al.
4,683,146 A 7/1987 Hirai et al.
4,683,147 A 7/1987 Eguchi et al.
4,777,103 A 10/1988 No et al.
4,795,691 A 1/1989 Takei et al.
5,112,709 A 5/1992 Yamazaki et al.
5,164,281 A 11/1992 Hayakawa et al.
5,392,098 A 2/1995 Ehara et al.

(Continued)

FOREIGN PATENT DOCUMENTS

EP 0 220 993 A2 5/1987
EP 1 158 368 A2 11/2001

(Continued)

OTHER PUBLICATIONS

European Search Report dated Mar. 9, 2011, in related corresponding European Patent Application No. 10192337.3.

*Primary Examiner* — Mark F Huff
*Assistant Examiner* — Rashid Alam
(74) *Attorney, Agent, or Firm* — Fitzpatrick, Cella, Harper & Scinto

(57) ABSTRACT

The present invention provides an electrophotographic photosensitive member including a photoconductive layer, an intermediate layer made of hydrogenated amorphous silicon carbide on the photoconductive layer, and a surface layer made of hydrogenated amorphous silicon carbide on the intermediate layer, wherein a ratio (C/(Si+C); C2) in the surface layer is 0.61 to 0.75, and a sum of atom density of silicon and carbon is $6.60\times10^{22}$ atoms/cm$^3$ or more, a ratio (C/(Si+C); C1) and a sum (D1) of atom density of silicon and carbon in the intermediate layer increase continuously from the photoconductive layer toward the surface layer without exceeding C2 and D2, and the intermediate layer has a continuous region in which C1 is 0.25 to C2 while D1 is $5.50\times10^{22}$ to $6.45\times10^{22}$ atoms/cm$^3$, the region being 150 nm or larger in a layer thickness direction, and an electrophotographic apparatus equipped therewith.

6 Claims, 4 Drawing Sheets

U.S. PATENT DOCUMENTS

| | | | | |
|---|---|---|---|---|
| 5,455,138 | A | 10/1995 | Okamura et al. | |
| 5,480,750 | A | 1/1996 | Kawada et al. | |
| 5,582,944 | A | 12/1996 | Yamamura et al. | |
| 5,817,181 | A | 10/1998 | Okamura et al. | |
| 5,849,446 | A | 12/1998 | Hashizume et al. | |
| 5,976,745 | A | 11/1999 | Aoki et al. | |
| 6,110,629 | A | 8/2000 | Ehara et al. | |
| 6,122,467 | A | 9/2000 | Ehara et al. | |
| 6,183,930 | B1 | 2/2001 | Ueda et al. | |
| 6,233,417 | B1 | 5/2001 | Nakayama et al. | |
| 6,238,832 | B1 | 5/2001 | Hashizume et al. | |
| 6,322,943 | B1 | 11/2001 | Aoki et al. | |
| 6,605,405 | B2 | 8/2003 | Owaki et al. | |
| 7,033,717 | B2 | 4/2006 | Kojima et al. | |
| 7,157,197 | B2 | 1/2007 | Aoki et al. | |
| 7,255,969 | B2 | 8/2007 | Kojima et al. | |
| 7,498,110 | B2 | 3/2009 | Taniguchi et al. | |
| 2010/0021835 | A1 | 1/2010 | Akiyama et al. | |
| 2010/0021836 | A1* | 1/2010 | Ozawa et al. | 430/66 |
| 2010/0021837 | A1 | 1/2010 | Ozawa et al. | |
| 2010/0112470 | A1 | 5/2010 | Ohira et al. | |

FOREIGN PATENT DOCUMENTS

| | | | |
|---|---|---|---|
| EP | 1 887 427 | A1 | 2/2008 |
| EP | 2 148 245 | A1 | 1/2010 |
| JP | 58-080656 | A | 5/1983 |
| JP | 04-093864 | A | 3/1992 |
| JP | 05-018471 | A | 1/1993 |
| JP | 06-102686 | A | 4/1994 |
| JP | 06-250425 | A | 9/1994 |
| JP | 07-043921 | A | 2/1995 |
| JP | 07-175244 | A | 7/1995 |
| JP | 08-022229 | A | 1/1996 |
| JP | 09-297420 | A | 11/1997 |
| JP | 10-104911 | A | 4/1998 |
| JP | 11-161120 | A | 6/1999 |
| JP | 2000-003055 | A | 1/2000 |
| JP | 03-124841 | A | 1/2001 |
| JP | 2001-330978 | A | 11/2001 |
| JP | 2002-123020 | A | 4/2002 |
| JP | 2002-148907 | A | 5/2002 |
| JP | 2002-229303 | A | 8/2002 |
| JP | 2002-296987 | A | 10/2002 |
| JP | 2003-107766 | A | 4/2003 |
| JP | 2003-107767 | A | 4/2003 |
| JP | 2003-337437 | A | 11/2003 |
| JP | 2004-077650 | A | 3/2004 |
| JP | 2004-126347 | A | 4/2004 |
| JP | 2004-133397 | A | 4/2004 |

* cited by examiner

ELECTROPHOTOGRAPHIC PHOTOSENSITIVE MEMBER AND ELECTROPHOTOGRAPHIC APPARATUS

BACKGROUND OF THE INVENTION

1. Field of the Invention

The present invention relates to an electrophotographic photosensitive member and electrophotographic apparatus.

2. Description of the Related Art

An electrophotographic photosensitive member which includes a photoconductive layer (photosensitive layer) made of an amorphous material on a substrate is well known, and in particular, electrophotographic photosensitive members which include a photoconductive layer of hydrogenated amorphous silicon (hereinafter also referred to as "a-Si:H") formed on a metal substrate by a layer formation technique such as CVD or PVD have already been introduced commercially. Hereinafter, an electrophotographic photosensitive member may be referred to simply as a "photosensitive member." Also, an electrophotographic photosensitive member provided with photoconductive layer made of a-Si:H may be referred to as "a-Si:H photosensitive member." Furthermore, a photoconductive layer made of a-Si:H may be referred to as an "a-Si:H photoconductive layer." A basic configuration of such an a-Si:H photosensitive member 4000 includes an a-Si:H photoconductive layer 4002 formed on a conductive substrate 4001 and a surface layer 4003 formed on the photoconductive layer 4002, as shown in FIG. 4. The surface layer 4003 contains hydrogenated amorphous silicon carbide (hereinafter also referred to as "a-SiC:H"). Hereinafter, a surface layer made of a-SiC:H may be referred to as an "a-SiC:H surface layer.

The surface layer 4003 is an important layer which has a bearing on electrophotographic characteristics. Characteristics required of the surface layer include wear resistance, moisture resistance, charge retention, and light transmission. Surface layer made of a-SiC:H excel especially in wear resistance and offer a good balance among the above-mentioned characteristics, and thus have been used mainly for electrophotographic apparatuses with high processing speed. However, conventional surface layer made of a-SiC:H could cause image deletion (hereinafter also referred to as "high-humidity image deletion") when used in high-humidity environment.

The high-humidity image deletion is an image defect which occurs in an electrophotographic process when image formation is repeated in a high-humidity environment and images are output again after a while and in which characters become blurred or characters fail to be printed. This phenomenon is caused in part by moisture adsorbed on a surface of the photosensitive member. To prevent occurrence of high-humidity image deletion, it is conventional practice to constantly heat the electrophotographic photosensitive member by a photosensitive-member heater, thereby reducing or removing the moisture adsorbed on the surface of the photosensitive member.

On the other hand, techniques have conventionally been proposed which prevent high-humidity image deletion without using a photosensitive-member heater. Japanese Patent No. 3124841 describes a technique for forming an a-SiC:H surface layer in an a-Si:H photosensitive member, which is made up of a photoconductive layer and the a-SiC:H surface layer formed in sequence on a substrate, wherein atom densities of silicon atoms, carbon atoms, and hydrogen or fluorine atoms in the a-SiC:H surface layer are reduced below predetermined values. The technique disclosed in Japanese Patent No. 3124841 gives a relatively coarse layer structure to the a-SiC:H surface layer by reducing the atom density of each atom in the a-SiC:H surface layer below the predetermined values, thereby allowing the surface layer to be scraped easily in a cleaning process. Consequently, it is stated that a new surface with reduced moisture absorption is always obtained, thereby allowing prevention of high-humidity image deletion.

On the other hand, from the viewpoint of charge retention, an attempt to improve an a-SiC:H surface layer has been proposed. Japanese Patent Publication No. H5-018471 proposes an a-Si:H photosensitive member made up of an a-Si:H photoconductive layer and two a-SiC:H surface layers formed in sequence on a substrate. With the technique disclosed in Japanese Patent Publication No. H5-018471, the outer of the two a-SiC:H surface layers has a higher defect density than the surface layer on the side of the photoconductive layer. Japanese Patent Publication No. H5-018471 states that the increased defect density in the outer surface layer enables forming a layer thickness needed to ensure wear resistance while improving charge mobility and preventing increase in residual potential. Also, Japanese Patent Publication No. H5-018471 states that the decreased defect density in the surface layer on the side of the photoconductive layer enables ensuring charge retention.

Recently, there has been demand to meet the needs for higher speed, higher image quality, and longer lives in electrophotographic processes while at the same time achieving power savings from the viewpoint of environmental friendliness. From this point of view, the photosensitive member is expected to be improved further. For example, regarding moisture resistance, image quality is required to be increased because high-humidity image deletion can cause deterioration of image quality. If the photosensitive-member heater is installed to prevent high-humidity image deletion, a considerable amount of standby power is required even when the electrophotographic apparatus is not running. Also, with the technique disclosed in Japanese Patent No. 3124841, a surface of the electrophotographic photosensitive member needs to be worn at a certain level of speed, and thus durability tends to be lost especially in a high-speed electrophotographic process. Possible causes of the durability loss include pressure scars and flaking as well as surface wear.

The pressure scars is a phenomenon in which image defects such as black streaks or white streaks appear on an image when mechanical stresses are applied to the electrophotographic photosensitive member. The pressure scars hardly occurs in normal use of the electrophotographic photosensitive member, but can occur on rare occasions when foreign matter is contained in printing paper. The pressure scars tends to stand out in a high-definition electrophotographic process especially when a halftone image is output. Thus, once it occurs, the pressure scars will reduce image quality and can result in shortening the life of the electrophotographic photosensitive member. The flaking is a phenomenon in which part of a surface layer flakes off. Once flaking occurs in an image forming area of the electrophotographic photosensitive member, it is difficult to continue using the electrophotographic photosensitive member. There is demand to satisfy durability and light transmittance at a higher level so as to support the latest electrophotographic processes while ensuring these properties, assuming a configuration in which no heater is used. Some of these properties are improved individually by the techniques described in Japanese Patent No. 3124841 and Japanese Patent Publication No. H5-018471. However, neither Japanese Patent No.

3124841 nor Japanese Patent Publication No. H5-018471 makes any technical suggestion on how to satisfy these properties at a higher level.

SUMMARY OF THE INVENTION

An object of the present invention is to provide an electrophotographic photosensitive member capable of effectively preventing image deletion even when applied to an electrophotographic apparatus which does not use a photosensitive-member heater as well as to provide an electrophotographic apparatus equipped with the electrophotographic photosensitive member.

The present invention provides an electrophotographic photosensitive member comprising a photoconductive layer, an intermediate layer made of hydrogenated amorphous silicon carbide on the photoconductive layer, and a surface layer made of hydrogenated amorphous silicon carbide on the intermediate layer, wherein in the surface layer, a ratio (C/(Si+C); C2) of the number of carbon atoms (C) to a sum of the number of silicon atoms (Si) and the number of carbon atoms (C) is between 0.61 and 0.75 (both inclusive), and a sum (D2) of atom density of silicon atoms and atom density of carbon atoms is $6.60\times10^{22}$ atoms/cm$^3$ or more, in the intermediate layer, a ratio (C/(Si+C); C1) of the number of carbon atoms (C) to a sum of the number of silicon atoms (Si) and the number of carbon atoms (C) as well as a sum (D1) of atom density of silicon atoms and atom density of carbon atoms increase continuously from the side of the photoconductive layer toward the side of the surface layer without exceeding C2 and D2, respectively, and the intermediate layer has a region in which C1 is equal to or larger than 0.25, but not larger than C2 while D1 is between $5.50\times10^{22}$ atoms/cm$^3$ and $6.45\times10^{22}$ atoms/cm$^3$ (both inclusive), the region being 150 nm or larger in a layer thickness direction of the intermediate layer. Also, the present invention provides an electrophotographic apparatus equipped with the electrophotographic photosensitive member described above.

By the formation of the specific surface layer and intermediate layer, the electrophotographic photosensitive member according to the present invention can effectively prevent image deletion even when applied to an electrophotographic apparatus which does not use a photosensitive-member heater. Also, the present invention can prevent occurrence of defects such as wear resistance, pressure scars and flaking.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
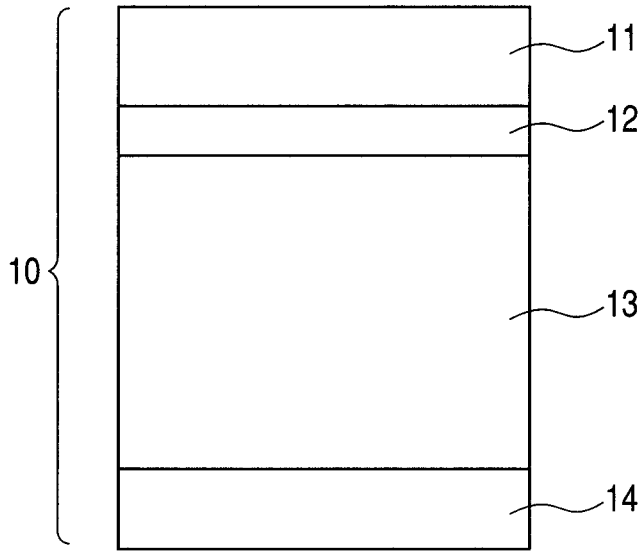
FIG. 1 is a diagram schematically showing an exemplary layer configuration of an electrophotographic photosensitive member according to the present invention.

A configuration and advantages of an electrophotographic photosensitive member according to the present invention will be described below. FIG. 1 is a diagram schematically showing an exemplary layer configuration of the electrophotographic photosensitive member according to the present invention. Referring to FIG. 1, the electrophotographic photosensitive member 10 includes a conductive substrate 14 made of aluminum or the like and formed into a cylindrical shape, and a photoconductive layer 13, an intermediate layer 12, and surface layer 11 formed in sequences on the substrate 14. Each layer and the substrate are configured as follows.

(Surface Layer)

The surface layer according to the present invention is made of a-SiC:H (hydrogenated amorphous silicon carbide). A ratio (C/(Si+C)) of the number of carbon atoms (C) to a sum of the number of silicon atoms (Si) and the number of carbon atoms (C) is between 0.61 and 0.75 (both inclusive), and a sum of atom density of silicon atoms and atom density of carbon atoms is $6.60\times10^{22}$ atoms/cm$^3$ or more. Hereinafter, the ratio (C/(Si+C)) of the number of carbon atoms (C) to the sum of the number of silicon atoms (Si) and the number of carbon atoms (C) may be referred to simply as "C/(Si+C)." Also, the sum of the atom density of silicon atoms and the atom density of carbon atoms may be referred to as "Si+C atom density." The present invention prevents occurrence of high-humidity image deletion by improving moisture resistance of the surface layer while maintaining or improving wear resistance of the surface layer.

Effects of the surface layer will be described in more detail below. High-humidity image deletion is caused in part by moisture absorption on the surface of the electrophotographic photosensitive member as described above, but in an early stage of use of the electrophotographic photosensitive member, the amount of moisture absorption is small and image deletion does not occur. After the electrophotographic photosensitive member is used for some time, an oxidized layer is formed and accumulated on the outermost surface under the action of ozone mainly due to an electrostatic process in the electrophotographic apparatus. The oxidized layer generates a polar group on the outermost surface, which is believed to cause increasing in the amount of moisture absorption. When the electrophotographic photosensitive member is continued to be used further, the oxidized layer continues to accumulate on the outermost surface. This is believed to cause increasing in the amount of moisture absorption, which subsequently becomes so large as to cause high-humidity image deletion. Therefore, to prevent high-humidity image deletion, it is necessary to remove the oxidized layer or suppress the formation of the oxidized layer itself. The present invention reduces the amount of moisture absorption by suppressing the formation of the oxidized layer and thereby prevents high-humidity image deletion.

The reason why configuration of the surface layer according to the present invention can suppress the formation of the oxidized layer is presumed to be as follows. It is speculated that oxidation of the surface layer made of a-SiC:H occurs when an oxidizing substance such as ozone acts on the surface of a-SiC:H, causing the bond between the silicon atom (Si) and carbon atom (C) to be broken, and the carbon atom (C) liberated as a result is replaced with oxygen atom (O). It is believed that the present invention reduces an average interatomic distance by increasing Si atom density and C atom density and suppresses the oxidation resulting from the liberation of carbon atoms (C) by reducing free volume. Also, it is presumed that such a layer increases binding forces among constituent atoms of the surface layer, increasing hardness of the surface layer and thereby improving wear resistance. The present invention, which suppresses surface oxidation itself as described above, provides the advantage of being able to prevent high-humidity image deletion while improving wear resistance without the need to increase amounts of wear in order to remove the oxidized layer.

For the reasons described above, the higher the Si+C atom density of the surface layer, the better. The Si+C atom density of $6.60\times10^{22}$ atoms/cm$^3$ or more offers the effect of preventing high-humidity image deletion and improving wear resistance. When the Si+C atom density of the surface layer is $6.81\times10^{22}$ atoms/cm$^3$ or more, the effect of preventing high-humidity image deletion and improving wear resistance is increased further. On the other hand, when C/(Si+C) is less than 0.61, resistance of a-SiC:H could reduce. In such a case, retained charges become prone to lateral migration. The lateral migration is insignificant compared to the high-humidity image deletion described above, but dot reproducibility is reduced in a latent image when isolated dots are formed in the image by image exposure light. The reduced dot reproducibility, which blurs boundaries between dots, is called image blur. Image blur will reduce image density of an output image especially on a low-density side, which in turn could reduce tonality. Therefore, C/(Si+C) needs to be 0.61 or more in the surface layer.

Also, in a surface layer in which Si+C density is high, light transmittance will often decrease slightly. In particular, when C/(Si+C) is increased, light transmittance will decrease remarkably, resulting in reduced optical sensitivity. Therefore, C/(Si+C) needs to be 0.75 or less. Thus, in the surface layer 11 according to the present invention, it is important that C/(Si+C) will be 0.61 to 0.75 (both inclusive) and that the Si+C atom density will be $6.60\times10^{22}$ atoms/cm$^3$ or more. Incidentally, it is assumed that the Si+C atom density in a-SiC:H is the highest when SiC is in crystalline state, and thus theoretically the Si+C atom density which the surface layer can have is $13.0\times10^{22}$ atoms/cm$^3$ or less.

Also, by keeping a ratio (H/(Si+C+H)) of the number of hydrogen atoms (H) to a sum of the number of silicon atoms (Si), the number of carbon atoms (C), and the number of hydrogen atoms (H) in the surface layer (hereinafter also referred to simply as "H/(Si+C+H)") between 0.30 and 0.45 (both inclusive), the present invention can further improve optical sensitivity while preventing high-humidity image deletion and maintaining wear resistance. That is, when H/(Si+C+H) is 0.30 or more in the surface layer, an optical band gap is widen, improving the optical sensitivity. On the other hand, when H/(Si+C+H) in the a-SiC:H surface layer is higher than 0.45, terminal groups, such as methyl groups, which contain a large number of hydrogen atoms tend to increase in the a-SiC:H surface layer. Such a layer will form much space in the structure and cause distortion in the bonds between surrounding atoms, and consequently the effect of improving oxidation resistance and wear resistance could be lost.

Also, according to the present invention, the wear resistance can be further improved if a ratio (hereinafter referred to as an "$I_D/I_G$ ratio") of a peak intensity $I_D$ of 1390 cm$^{-1}$ to a peak intensity $I_G$ of 1480 cm$^{-1}$ in a Raman spectrum of the surface layer is set between 0.20 and 0.70 (both inclusive). The Raman spectrum of the a-SiC:H surface layer will be described in comparison with diamond-like carbon (hereinafter also referred to as "DLC"). DLC made up of sp$^3$ structure and sp$^2$ structure exhibits an asymmetrical Raman spectrum which has a major peak around 1540 cm$^{-1}$ and a shoulder band around 1390 cm$^{-1}$. The a-SiC:H surface layer formed by an RF-CVD process exhibits a Raman spectrum which is similar to that of the DLC, having a major peak around 1480 cm$^{-1}$ and a shoulder band around 1390 cm$^{-1}$. It is because the a-SiC:H surface layer contains silicon atoms that the major peak of the a-SiC:H surface layer is shifted to the lower-wavenumber side compared to DLC. Thus, it can be seen that the a-SiC:H surface layer formed by the RF-CVD process has a structure very close to that of DLC.

Generally, in the Raman spectrum of DLC, it is known that the smaller the ratio of a peak intensity in a low-wavenumber band to a peak intensity in a high-wavenumber band, the higher the sp$^3$ content of DLC tends to be. Since the a-SiC:H surface layer has a structure very close to that of DLC, it is believed that the smaller the ratio of a peak intensity in a low-wavenumber band to a peak intensity in a high-wavenumber band, the higher the sp$^3$ content of the a-SiC:H surface layer also tends to be. It is believed that with increase of the sp$^3$ content, the number of two-dimensional sp$^2$ networks decreases and the number of three-dimensional sp$^3$ networks increases, increasing the number of bonds among skeletal atoms and resulting in a rigid structure. Therefore, the smaller the ratio of the peak intensity $I_D$ of 1390 cm$^{-1}$ to the peak intensity $I_G$ of 1480 cm$^{-1}$ in the Raman spectrum of the surface layer, the more desirable it is, and the ratio of 0.70 or less will further improve the wear resistance.

On the other hand, generally the sp$^2$ structure cannot be removed completely form the a-SiC:H surface layers formed in mass production level. Therefore, according to the present invention, a lower limit of the $I_D/I_G$ ratio for the Raman spectrum of the a-SiC:H surface layer is set to 0.20 or more confirmed in the present embodiment to be a range which provides good resistance to high-humidity image deletion and wear. The surface layer according to the present invention may be formed by any method as long as the method can form a deposition layer (deposit film) which satisfies the values prescribed above. Available methods for that include a plasma CVD process, vacuum deposition process, sputtering process, and ion plating process. However, the plasma CVD process is the most suitable in terms of ease of raw material supply.

When the plasma CVD process is used as a formation method, the surface layer can be formed as follows. Basically, a source gas for use to supply silicon atoms and a source gas for use to supply carbon atoms are introduced in desired gaseous state into a process chamber which can be depressurized, and then a glow discharge is produced in the process chamber. Consequently, the introduced source gases are decomposed and an a-SiC:H layer can be formed on a conductive substrate set up at a predetermined location. According to the present invention, as source gases of silicon atoms, silanes such as silane ($SiH_4$) and disilane ($Si_2H_6$) can be used suitably. As source gases of carbon atoms, gases such as methane ($CH_4$) and acetylene ($C_2H_2$) can be used suitably. Besides, hydrogen ($H_2$) may be used together with the source gases described above, mainly to adjust H/(Si+C+H).

In forming the surface layer according to the present invention, generally the Si+C atom density tends to become high if flow rates of the gases supplied to the process chamber are decreased and high-frequency power and substrate temperature are increased although this depends on condition and apparatus used during formation of the surface layer. Actually, these conditions can be specified in an appropriate combination.

(Intermediate Layer)

The intermediate layer according to the present invention is made of a-SiC:H and has the following features. A ratio (C/(Si+C); C1) of the number of carbon atoms (C) to the sum of the number of silicon atoms (Si) and the number of carbon atoms (C) in the intermediate layer increases continuously from the side of the photoconductive layer toward the side of the surface layer without exceeding the ratio (C/(Si+C); C2) of the number of carbon atoms (C) to the sum of the number of silicon atoms (Si) and the number of carbon atoms (C) in the surface layer. The sum (D1) of the atom density of silicon atoms and the atom density of carbon atoms in the intermediate layer increases continuously from the side of the photoconductive layer toward the side of the surface layer without exceeding the sum (D2) of the atom density of silicon atoms and the atom density of carbon atoms in the surface layer. The intermediate layer has a region in which C1 is equal to or larger than 0.25, but not larger than C2 while D1 is between $5.50\times10^{22}$ atoms/cm$^3$ and $6.45\times10^{22}$ atoms/cm$^3$ (both inclusive), the region being 150 nm or larger in a layer thickness direction of the intermediate layer.

Effects of the intermediate layer will be described in detail below. When used in combination with the surface layer, the intermediate layer has the capabilities to increase adhesion of the surface layer and prevent flaking as well as to protect the photoconductive layer from mechanical stresses and prevent pressure scars. A major cause of flaking is considered to be excessive thermal or mechanical shock or vibrations occurring, for example, during transportation of electrophotographic photosensitive member. It is considered that flaking rarely occurs during normal use of the electrophotographic photosensitive member. However, once the electrophotographic photosensitive member is subjected to a history of shock or vibrations such as described above, stresses are accumulated mainly between the photoconductive layer and surface layer, increasing the risk of flaking with long-term use. Especially, surface layers with the above-described properties are speculated to be at high risk because layer stress tends to be high.

By increasing C1 and D1 continuously from the side of the photoconductive layer toward the side of the surface layer, the intermediate layer according to the present invention can prevent accumulation of stresses and effectively reduce the risk of flaking. According to the present invention, increasing C1 and D1 continuously from the side of the photoconductive layer toward the side of the surface layer means changing C1 and D1 in the intermediate layer so as to bond photoconductive layer and surface layer without any gap. Therefore, C1 and D1 may be increased monotonously from the side of the photoconductive layer toward the side of the surface layer or may have fixed regions in the intermediate layer. Also, C1 and D1 may have regions which decrease partially.

The change does not have a significant effect compared to when there is a gap if an amount of change relative to layer thickness is too large. Therefore, desirably the amount of change in C1 per 10 nm of layer thickness is kept to 20% or less of difference between C/(Si+C) in the photoconductive layer and C/(Si+C) in the surface layer. Also, desirably the amount of change in D1 per 10 nm of layer thickness is kept to 20% or less of difference between the Si+C atom density in the photoconductive layer and the Si+C atom density in the surface layer. Even if the intermediate layer has a region in which C1 or D1 tends to decrease partially, there is no problem if difference between maximum value and minimum value of C1 is equal to or less than 5% of the maximum value of C1, and similarly there is no problem if difference between maximum value and minimum value of D1 is equal to or less than 5% of the maximum value of D1.

It is considered that pressure scars is caused when mechanical stress is applied to a surface of the electrophotographic photosensitive member by some hard foreign object entrapped in the electrophotographic apparatus for some reason during use. However, this does not necessarily leave a flaw on the surface of the electrophotographic photosensitive member. Also, there are cases in which pressure scars once caused to the electrophotographic photosensitive member disappears after the electrophotographic photosensitive member is heated, for example, at a temperature of 200° C. for 1 hour. Therefore, it is believed that pressure scars occurs when excessive stress is applied to the photoconductive layer via the surface layer rather than directly to the surface of the electrophotographic photosensitive member. Occurrence of such pressure scars can be prevented if the surface layer is made very hard, but the intermediate layer according to the present invention can effectively relax the mechanical stress applied to the surface layer, by making the Si+C atom density of the intermediate layer lower than that of the surface layer. Thus, the present invention offers the advantage of preventing pressure scars more effectively than when no intermediate layer is provided.

To obtain the effect described above, the intermediate layer according to the present invention needs to have Si+C atom density lower than that of the surface layer, but too low the Si+C atom density mars the pressure scars prevention effect. Presumably, this is because in order for the intermediate layer to effectively alleviate stress, there is an optimum range for balance between the Si+C atom density of the intermediate layer and the Si+C atom density of the surface layer. Thus, according to the present invention, a range of D1 in the intermediate layer found to be effective in relation to the range of D2 in the surface layer is designated to be between $5.50\times10^{22}$ atoms/cm$^3$ and $6.45\times10^{22}$ atoms/cm$^3$ (both inclusive).

The effect of C1 in the intermediate layer is approximately equivalent to the effect of C2 in the surface layer. That is, with decreases in C1, layer resistance becomes prone to reduce. However, in the intermediate layer, since C1 and D1 change continuously, starting from the side of the photoconductive layer, in a region whose Si+C atom density is low in relation to the surface layer, occurrence of lateral charge migration is reduced, making the intermediate layer less liable to image blur than the surface layer. Therefore, a lower limit of the C1 range may be smaller than a lower limit of the C2 range in the surface layer, provided that the C1 lower limit is not smaller than 0.25.

When C1 becomes higher than a certain level, the light transmission tends to low. Especially when C1 is higher than C2, the optical sensitivity decreases considerably. Presumably, this is due to circumstances such as refraction and reflection of light existing between the surface of the electrophotographic photosensitive member and the photoconductive layer. Thus, C1 is set between 0.25 and C2 (both inclusive). Hereinafter, such a range in the intermediate layer that satisfies the ranges of C1 and D1 may be referred to as "region A."

To prevent pressure scars in the intermediate layer, it is important that there exists region A as described above. Therefore, as a layer thickness for use in preventing pressure scars, the present invention stipulates the thickness of region A rather than the layer thickness of the intermediate layer. A specific effect is obtained when region A is 150 nm thick or more. An upper limit of the thickness of region A can be determined based on the time required to produce the electrophotographic photosensitive member, and is set to 750 nm or more as demonstrated in the present invention. Region A may be formed in the region in which C1 and D1 increase continuously from the side of the photoconductive layer toward the side of the surface layer, where C1 or D1 may be increased monotonously or may have a fixed region or a region which decreases partially. Region A may exist in any of these forms as long as region A satisfies C1 and D1 in the intermediate layer and has a total thickness of 150 nm or more in the layer thickness direction of the intermediate layer. Desirably, region A is suitable for a contiguous region which is 150 nm or more in the layer thickness direction of the intermediate layer.

Figure 5:
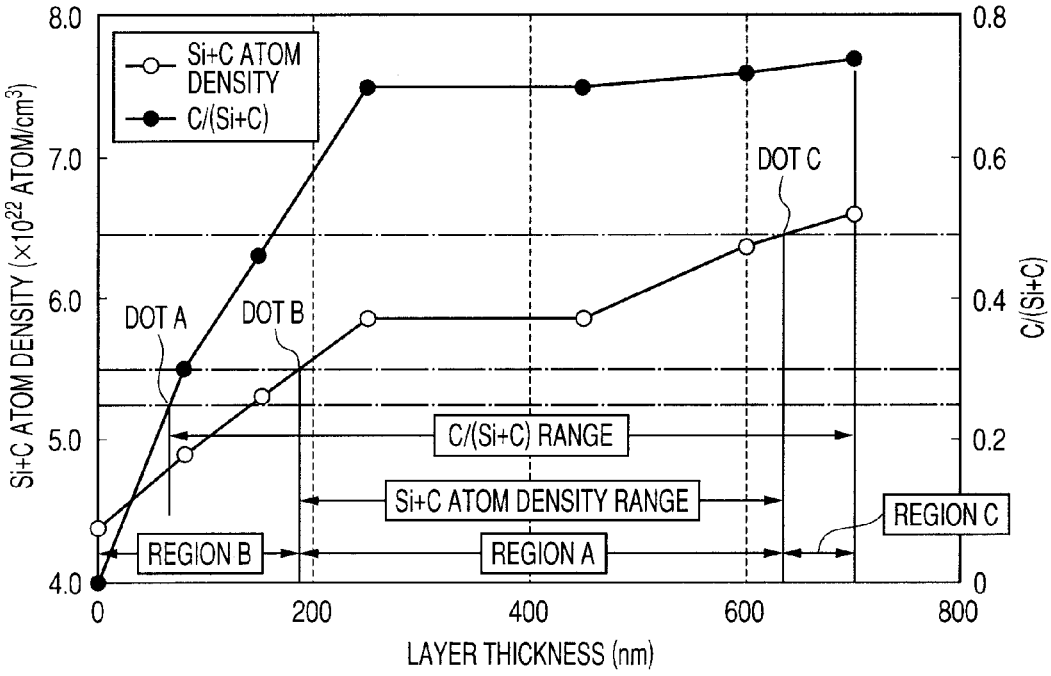
FIG. 5 is a diagram showing Si+C atom density and C/(Si+C) distribution in an intermediate layer according to the present invention.

Hereinafter, in the intermediate layer, a region extending from the side of the photoconductive layer to region A will be referred to as region B and a region extending from region A to the side of the surface layer will be referred to as region C. Relationship among regions A, B, and C is shown in FIG. 5. With the intermediate layer according to the present invention, since C1 and D1 are increased continuously from the side of the photoconductive layer toward the side of the surface layer, part of C1 and D1 will be outside the range of region A in the intermediate layer. In region B, C1 becomes smaller than in region A, but since D1 in region A becomes smaller than in the surface layer, resistance changes do not have a significant impact. Also since continuous changes of C1 and D1 make lateral charge migration itself less liable to occur, region B does not cause any noticeable image blur.

That is, according to the present invention, image blur can be prevented if C1 is 0.25 or more in all the regions in which D1 falls inside the range described above. Referring to FIG. 5, this condition is met if the layer thickness of the part (dot A) where C1 is 0.25 or more is smaller than the layer thickness of the part (dot B) where D1 is $5.50\times10^{22}$ atoms/cm$^3$ or more. Incidentally, the term "layer thickness" as used herein means the total layer thickness in the intermediate layer as viewed from the side of the photoconductive layer. As described above, the effects of the intermediate layer according to the present invention are obtained regardless of regions B and C. Considering the layer thickness of the entire intermediate layer, the thicknesses of regions B and C can be set equal to or smaller than the rate of change of C1 or D1. Specifics can be determined based on characteristics of apparatuses used for manufacture of the electrophotographic photosensitive member. However, too large thickness is not realistic, and desirably the layer thicknesses of regions B and C are less than about four times the layer thickness of region A.

Also, according to studies conducted by the present inventor, the light transmission of the intermediate layer is influenced predominantly by C1 and D1, and there is not much dependence on H/(Si+C+H). It is believed that this is because the atom density in the intermediate layer is lower than in the surface layer, decreasing the dependence of light transmittance on the atom density of hydrogen atoms. As described above, using the combination of the surface layer and intermediate layer, the present invention effectively prevents high-humidity image deletion while improving wear resistance, prevents flaking and pressure scars, and improves optical sensitivity. The intermediate layer can be formed using a method similar to the one used to form the surface layer and by adjusting and changing conditions such as amounts of gases supplied to the process chamber, high-frequency power, pressure in the process chamber, and temperature of the conductive substrate as required.

(Photoconductive Layer)

The photoconductive layer of the electrophotographic photosensitive member according to the present invention may be of any type as long as the photoconductive layer has such photoconductive characteristics that offer satisfactory performance in terms of electrophotographic characteristics. However, a photoconductive layer made of a-Si:H is most suitable, in terms of durability and stability, for the intermediate layer and surface layer according to the present invention. When a-Si:H is used for the photoconductive layer according to the present invention, halogen atoms can be included, in addition to the hydrogen atoms, to terminate dangling bonds in the a-Si:H. Desirably, total content of hydrogen atoms (H) and halogen atoms is between 10 and 40 atomic % (both inclusive) of a sum of silicon atoms, hydrogen atoms, and halogen atoms, and more desirably between 15 and 35 atomic % (both inclusive).

According to the present invention, atoms for use to control conductivity can be included in the photoconductive layer, as required. The atoms used to control conductivity may be included, being distributed uniformly all over the photoconductive layer or being distributed unevenly in some part in the layer thickness direction. Examples of the atoms used to control conductivity include atoms known as impurities in the semiconductor field. Specifically, the atoms available for use are atoms which belong to group 13 of the periodic table (hereinafter referred to as "13th group atoms") and exhibit p-type conductivity or atoms which belong to group 15 of the periodic table (hereinafter referred to as "15th group atoms") and exhibit n-type conductivity.

Specifically, the 13th group atoms include boron (B), aluminum (Al), gallium (Ga), indium (In), and thallium (Tl), of which boron, aluminum, or gallium can be used suitably. The 15th group atoms include phosphorus (P), arsenic (As), antimony (Sb), and bismuth (Bi), of which phosphorus or arsenic can be used suitably. Desirably, content of the atoms included in the photoconductive layer to control conductivity is between $1\times10^{-2}$ and $1\times10^{4}$ atomic ppm (both inclusive) based on Si, more desirably between $5\times10^{-2}$ and $5\times10^{3}$ atomic ppm (both inclusive), and most desirably between $1\times10^{-1}$ and $1\times10^{3}$ atomic ppm (both inclusive).

According to the present invention, the layer thickness of the photoconductive layer is determined as desired to attain desired photoconductive characteristics while achieving economic efficiency. Desirably the layer thickness is 15 μm or more, and more desirably 20 μm or more. Also, desirably the layer thickness is 60 μm or less, more desirably 50 μm or less, and most desirably 40 μm or less. Incidentally, the photoconductive layer may have a single-layer structure as described above or a multi-layer structure made up of a charge generating layer and a charge transport layer separately. The a-Si:H photoconductive layer may be formed by a plasma CVD process, vacuum deposition process, sputtering process, ion plating process, or the like. However, the plasma CVD process is the most suitable in terms of ease of raw material supply and the like.

(Substrate)

The substrate is not particularly limited, and may be of any type as long as the substrate has electrical conductivity and can hold the photoconductive layer and surface layer formed thereon. Available materials include metals such as Al, Cr, Mo, Au, In, Nb, Te, V, Ti, Pt, Pd, and Fe as well as alloys thereof such as Al alloys and stainless steel. Besides, the substrate may be a film or a sheet made of synthetic resin such as polyester, polyethylene, polycarbonate, cellulose acetate, polypropylene, polyvinyl chloride, polystyrene, or polyamide, or an electrically insulating substrate made of glass, or ceramic. In this case, at least that surface of the electrically insulating substrate on which the photoconductive layer is formed can be treated to be electrically conductive. Regarding the layer configuration of the electrophotographic photosensitive member according to the present invention, other than the one described above, the layer configuration may include, for example, an upper charge injection preventing layer or lower charge injection preventing layer formed on or under the photoconductive layer.

Figure 2:
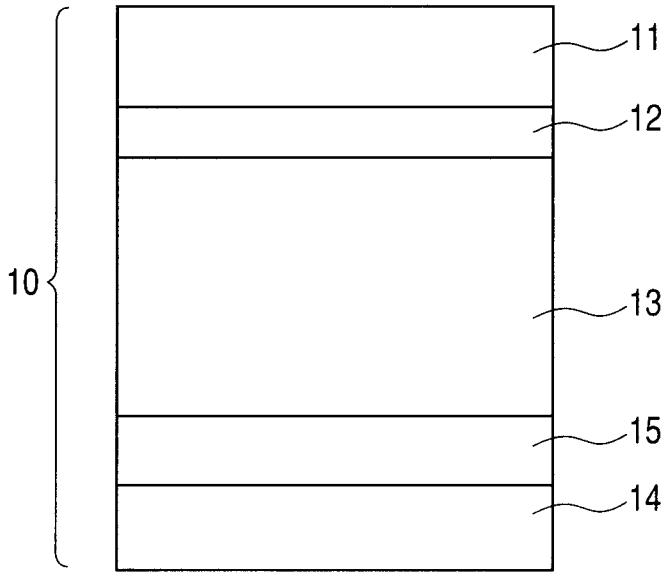
FIG. 2 is a diagram schematically showing an exemplary layer configuration of the electrophotographic photosensitive member according to the present invention.

The lower charge injection preventing layer and upper charge injection preventing layer can be formed based on the material used for the photoconductive layer. According to the present invention, when an upper charge injection preventing layer is formed on the photoconductive layer, the intermediate layer can be provided between the upper charge injection preventing layer and surface layer. As an example, FIG. 2 schematically shows a layer configuration of the electrophotographic photosensitive member which includes a lower charge injection preventing layer. In the example of FIG. 2, the configuration of the electrophotographic photosensitive member 10 includes the lower charge injection preventing layer 15, photoconductive layer 13, intermediate layer 12, and surface layer 11 formed in sequence on the substrate 14. A so-called transition layer may be provided as required between the lower charge injection preventing layer 15 and photoconductive layer 13, allowing gradual transition of composition between the two layers.

Figure 3:
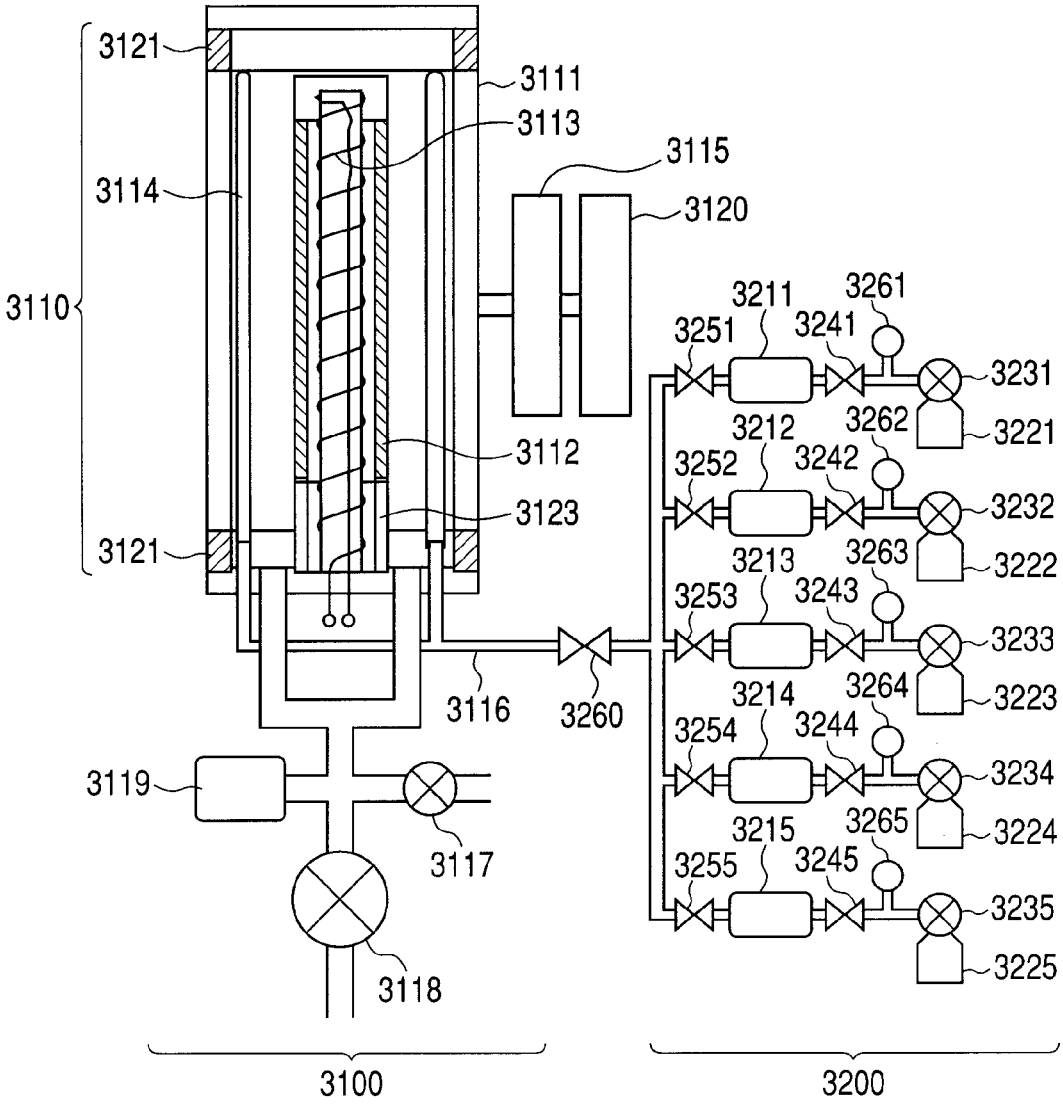
FIG. 3 is a diagram showing an example of deposition layer forming apparatus using a plasma CVD process.
Figure 4:
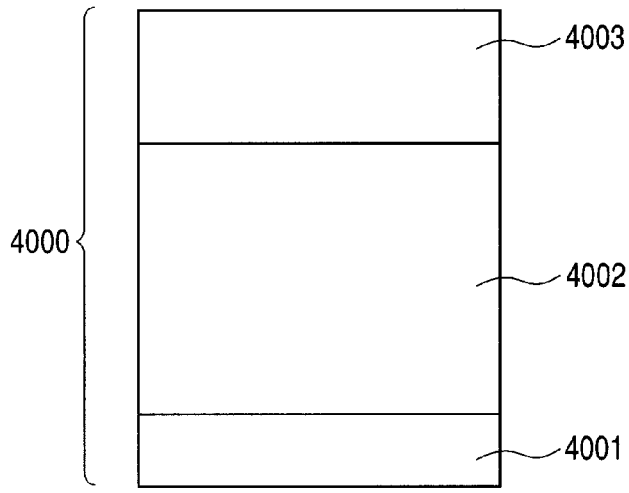
FIG. 4 is a diagram schematically showing an exemplary layer configuration of an electrophotographic photosensitive member.

Next, procedures for producing the electrophotographic photosensitive member according to the present invention will be described in detail by taking as an example the use of the plasma CVD process and by referring to drawings. FIG. 3 is a block diagram schematically showing an example of a photosensitive member manufacturing apparatus based on the plasma CVD process which uses the RF band as power supply frequency. The apparatus mainly includes a deposition apparatus 3100, source gas supplying apparatus 3200, and exhaust apparatus (not shown) adapted to reduce pressure in a process chamber 3110. The deposition apparatus 3100 includes an insulator 3121 and cathode electrode 3111 which is connected to a high-frequency power source 3120 via a high-frequency matching box 3115. Also, a stand 3123, substrate heater 3113, and source gas inlet pipe 3114 are installed in the process chamber 3110, where the stand 3123 is used to mount a cylindrical substrate 3112. The process chamber 3110 is connected with the exhaust apparatus (not shown) via an exhaust valve 3118 and designed to be able to be evacuated. The source gas supplying apparatus 3200 includes source gas bombs 3221, 3222, 3223, 3224, and 3225; valves 3231, 3232, 3233, 3234, and 3235; valves 3241, 3242, 3243, 3244, and 3245; valves 3251, 3252, 3253, 3254, and 3255; pressure adjuster 3261, 3262, 3263, 3264 and 3265, and mass flow controllers 3211, 3212, 3213, 3214, and 3215. The source gas bombs are connected to the source gas inlet pipe 3114 in the process chamber 3110 via a valve 3260 and gas pipe 3116. Deposition layers are formed using this apparatus, for example, as follows.

First, the substrate 3112 is set in the process chamber 3110, and the process chamber 3110 is evacuated using the exhaust apparatus (not shown) such as a vacuum pump. Next, temperature of the substrate 3112 is controlled at a predetermined temperature between 200° C. and 350° C. (both inclusive) using the substrate heater 3113. Next, the source gases for formation of a deposition layer are introduced into the process chamber 3110 by controlling their flow rates using the source gas supplying apparatus 3200. Then, while checking readout of a vacuum gage 3119, the operator sets a predetermined pressure by operating the exhaust valve 3118. When preparations for deposition are completed in the manner described above, the layers are formed using the following procedures.

When the pressure is stabilized, the high-frequency power source 3120 is set to predetermined power and power is supplied to the cathode electrode via the high-frequency matching box 3115 to produce a high-frequency glow discharge. Regarding the frequency used for the discharge, the RF band in the range of 1 MHz to 30 MHz (both inclusive) is used suitably. The source gases introduced into the process chamber 3110 are decomposed by energy of the discharge, and consequently a deposition layer composed principally of predetermined silicon atoms is formed on the substrate 3112. When desired layer thickness is obtained, the operator stops high-frequency power supply, closes the valves of the gas supplying apparatus to stop inflow of the source gases into the process chamber 3110, and thereby finishes the formation of the deposition layer. Similar operations are repeated multiple times by changing conditions of the flow rates of the source gases, the pressure, and the high-frequency power until a desired electrophotographic photosensitive member of a multi-layer structure is produced.

Also, to achieve uniform layer formation, it is useful to rotate the substrate 3112 at a predetermined speed by a driving device (not shown) during the layer formation. When formation of all the deposition layers is finished, the operator opens a leaking valve 3117, thereby bringing the process chamber 3110 to atmospheric pressure, and takes out the substrate 3112.

Next, examples of the present invention will be described in detail.

Examples 1 to 4 and Comparative Examples 1 and 2

A cylinder 84 mm in diameter, 381 mm in length, and 3 mm in wall thickness was used as a conductive substrate. The cylinder was made of aluminum material whose surface had been polished to a mirror-like finish. An electrophotographic photosensitive member was produced using the procedures described above. In the present examples and present comparative examples, the electrophotographic photosensitive members had a layer configuration made up of the lower charge injection preventing layer, the photoconductive layer, the intermediate layer, and the surface layer as shown in FIG. 2. Formation conditions (layer formation conditions) of the lower charge injection preventing layer and the photoconductive layer are shown in Table 1. In all the subsequent examples and comparative examples, the conditions shown in Table 1 were used for the lower charge injection preventing layer and the photoconductive layer. Also, formation conditions (layer formation conditions) of the intermediate layer and the surface layer are shown in Tables 2 to 7.

TABLE 1

| | Lower charge injection preventing layer | Photoconductive layer |
|---|---|---|
| Gas types and flow rates | | |
| $SiH_4$ [mL/min (normal)] | 350 | 450 |
| $H_2$ [mL/min (normal)] | 750 | 2200 |
| $B_2H_6$ [ppm] (Based on $SiH_4$) | 1500 | 1 |
| NO [mL/min (normal)] | 10 | |

TABLE 1-continued

| | Lower charge injection preventing layer | Photoconductive layer |
|---|---|---|
| Internal pressure [Pa] | 40 | 80 |
| High-frequency power [W] | 400 | 800 |
| Temperature of substrate [° C.] | 260 | 260 |
| Layer thickness [μm] | 3 | 25 |

TABLE 2

| | Example 1 (layer formation condition 1) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 320 | 150 | 50 | 50 | 38 | 26 | 26 |
| $CH_4$ [mL/min (normal)] | 0 | 250 | 560 | 750 | 750 | 620 | 500 | 500 |
| Internal pressure [Pa] | 95 | 95 | 95 | 95 | 95 | 90 | 80 | 80 |
| High-frequency power [W] | 350 | 350 | 350 | 350 | 350 | 480 | 600 | 600 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 3

| | Example 2 (layer formation condition 2) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 320 | 150 | 50 | 50 | 38 | 26 | 26 |
| $CH_4$ [mL/min (normal)] | 0 | 250 | 560 | 750 | 750 | 600 | 450 | 450 |
| Internal pressure [Pa] | 95 | 95 | 95 | 95 | 95 | 90 | 80 | 80 |
| High-frequency power [W] | 350 | 350 | 350 | 350 | 350 | 530 | 700 | 700 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 4

| | Example 3 (layer formation condition 3) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 320 | 150 | 50 | 50 | 38 | 26 | 26 |
| $CH_4$ [mL/min (normal)] | 0 | 250 | 560 | 750 | 750 | 520 | 400 | 400 |
| Internal pressure [Pa] | 95 | 95 | 95 | 95 | 95 | 90 | 80 | 80 |
| High-frequency power [W] | 350 | 350 | 350 | 350 | 350 | 530 | 750 | 750 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 5

| | Example 4 (layer formation condition 4) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 320 | 150 | 50 | 50 | 38 | 26 | 26 |
| $CH_4$ [mL/min (normal)] | 0 | 250 | 560 | 750 | 750 | 500 | 360 | 360 |

TABLE 5-continued

| | Example 4 (layer formation condition 4) | | | | | | | |
|---|---|---|---|---|---|---|---|---|
| | Intermediate layer | | | | | | | Surface |
| | A | B | C | D | E | F | G | layer |
| Internal pressure [Pa] | 95 | 95 | 95 | 95 | 95 | 90 | 80 | 80 |
| High-frequency power [W] | 350 | 350 | 350 | 350 | 350 | 600 | 850 | 850 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 6

| | Comparative example 1 (layer formation condition 5) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 320 | 150 | 50 | 50 | 38 | 26 | 26 |
| $CH_4$ [mL/min (normal)] | 0 | 250 | 560 | 750 | 750 | 725 | 700 | 700 |
| Internal pressure [Pa] | 95 | 95 | 95 | 95 | 95 | 90 | 80 | 80 |
| High-frequency power [W] | 350 | 350 | 350 | 350 | 350 | 400 | 450 | 450 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 7

| | Comparative example 2 (layer formation condition 6) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 320 | 150 | 50 | 50 | 38 | 26 | 26 |
| $CH_4$ [mL/min (normal)] | 0 | 250 | 560 | 750 | 750 | 1100 | 1400 | 1400 |
| Internal pressure [Pa] | 95 | 95 | 95 | 95 | 95 | 75 | 55 | 55 |
| High-frequency power [W] | 350 | 350 | 350 | 350 | 350 | 380 | 400 | 400 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

In Tables 2 to 7, the formation conditions (layer formation conditions) of the intermediate layer are divided into seven points A to G, and the layer formation conditions are changed so as to be linearly interpolated between the points. Incidentally, in the intermediate layer, the layer thickness at each point is counted from point A. This means that the intermediate layer was formed from point A on the side of the photoconductive layer to point G on the side of the surface layer with a layer thickness of 700 nm. The Si+C atom density, H/(Si+C+H), C/(Si+C), $I_D/I_G$ ratio of the electrophotographic photosensitive members thus produced were measured using the following analytical methods.

<Si+C Atom Density and H/(Si+C+H)>

Reference samples were created by producing an item in which only the lower charge injection preventing layer was formed on the substrate and an item in which only the lower charge injection preventing layer and photoconductive layer were formed on the substrate under the same conditions as the electrophotographic photosensitive members produced in the present examples and present comparative examples and then cutting out longitudinal center parts 15 mm square. Next, to measure the density of the intermediate layer, a sample for intermediate layer measurement was created by producing an item in which the lower charge injection preventing layer, photoconductive layer, and intermediate layer were formed in this order on the substrate under the same conditions as the examples and comparative examples and cutting out a center part in the same manner as the reference samples.

Then, samples for surface layer measurement were created as follows, that is, center parts of the electrophotographic photosensitive members produced in the example and comparative example were cut out in the same manner as the reference samples. Separate from this, to measure the refractive index and layer thickness of the intermediate layer, each sample for point-specific intermediate layer measurement was created as follows, that is, the lower charge injection preventing layer and photoconductive layer were formed on the substrate, the intermediate layer was formed thereon under given conditions of each layer formation point, and a center part was cut out in the manner described above. That is, to prepare each sample separately, after the lower charge injection preventing layer and photoconductive layer were formed, the intermediate layer was formed thereon with a layer thickness of 0.5 μm, representing one of points A to G, and the center part was cut out in the manner described above. The reference samples, sample for intermediate layer measurement, and samples for surface layer measurement were measured using spectroscopic ellipsometry (High-Speed Spectroscopic Ellipsometer M-2000 made by J.A. Woollam Co. Inc.) and thereby the layer thicknesses and refractive indices of the surface layer and intermediate layer were determined.

Specific measurement conditions were as follows. Incident angles were 60°, 65°, and 70°. Measurement wavelength was 195 nm to 700 nm (both inclusive). Analysis software used was WVASE 32. Beam diameter was 1 mm×2 mm. First, reference samples were measured at each incident angle using spectroscopic ellipsometry to determine relationships between a wavelength and an amplitude ratio Ψ and between a wavelength and a phase difference Δ. Next, using measurement results of the reference samples as a reference, relationships between a wavelength and an amplitude ratio Ψ and between a wavelength and a phase difference Δ of each measurement sample was determined at each incident angle by spectroscopic ellipsometry as in the case of the reference samples.

Next, the lower charge injection preventing layer, the photoconductive layer, the intermediate layer, and the surface layer were formed in sequence, and then a coarse layer with a surface-layer to air-layer volume ratio of 8:2 was formed on the outermost surface. Using this layer configuration as a calculation model, relationships between the wavelength and the amplitude ratio Ψ and between the wavelength and the phase difference Δ at each incident angle was determined by calculation. WVASE 32 produced by J.A. Woollam Co., Inc. was used as analysis software. Using the relationships between the wavelength and the amplitude ratio Ψ and between the wavelength and the phase difference Δ determined by calculation and the relationships between the wavelength and the amplitude ratio Ψ and between the wavelength and the phase difference Δ measured from the measurement samples, the surface layer's layer thickness which minimizes the mean-square error between the two relationships was calculated and designated as the layer thickness of the surface layer. Regarding the intermediate layer, the samples for point-specific intermediate layer measurement were measured, the layer thickness and refractive index of the deposition layer produced at each point were determined, and a calculation model was created based thereon. Deposition rate was calculated using the layer thickness of the deposition layer produced at each point and then formation time of the deposition layer was adjusted so as to obtain the layer thicknesses of the intermediate layer shown in Tables 2 to 7.

Subsequently, using the samples for surface layer measurement and samples for point-specific intermediate layer measurement, the numbers of silicon atoms and carbon atoms at the points in the surface layer and in the intermediate layer were measured by RBS (Rutherford Backscattering Spectrometry). The numbers of atom were counted in the measurement area of RBS. The measuring instrument used was backscattering measuring instrument AN-2500 made by NHV Corporation. Using the values thus obtained, C/(Si+C) was calculated. The atom density of silicon atoms, atom density of carbon atoms, and Si+C atom density were calculated based on the numbers of silicon atoms and carbon atoms measured in the measurement area of RBS, using the layer thicknesses of the surface layer determined by spectroscopic ellipsometry and the 0.5 μm layer thickness of the intermediate layer. Hereinafter, the atom density of silicon atoms may be referred to as "Si atom density" and the atom density of carbon atoms may be referred to as "C atom density."

Together with RBS, the number of hydrogen atoms in the intermediate layer and surface layer of the above-described samples was measured by HFS (Hydrogen Forward scattering Spectrometry) based on the measurement area of HFS (using backscattering measuring instrument AN-2500 made by NHV Corporation). The atom density of hydrogen atoms was calculated from the number of hydrogen atoms measured in the measurement area of HFS and the layer thicknesses determined by ellipsometry. Also, H/(Si+C+H) in the measurement area of HFS was determined from the number of silicon atoms and number of carbon atoms in the measurement area of RBS. Hereinafter, the atom density of hydrogen atoms may be referred to as "H atom density." Specific measurement conditions were as follows. Incident ions were $4He^+$, incident energy was 2.3 MeV, incident angle was 75°, sample current was 35 nA, and beam diameter was 1 mm. An RBS detector took measurements using scattering angle of 160° and aperture diameter of 8 mm. An HFS detector took measurements using recoil angle of 30° and aperture diameter of 8 mm+slit.

($I_D/I_G$ Ratio)

To determine the $sp^3$ content, a sample created by cutting out a longitudinal center part 10 mm square at an arbitrary circumferential position from the electrophotographic photosensitive member was measured by a laser Raman spectrophotometer (NRS-2000 made by JASCO Corporation). Specific measurement conditions were as follows. The light source used was a 514.5 nm Ar+laser with a laser intensity of 20 mA and objective lens magnification of 50. Three sets of measurements were taken, each with five times integrations, using a center wavelength of 1380 $cm^{-1}$ and exposure time of 30 seconds. The Raman spectrum thus obtained was analyzed as follows. A peak wavenumber of a shoulder Raman band was fixed at 1390 $cm^{-1}$, and a peak wavenumber of a main Raman band was set at 1480 $cm^{-1}$, but not fixed thereto. Then, curve fitting was performed using a Gaussian distribution. In so doing, a base line was set by linear approximation. The $I_D/I_G$ ratio was found from the peak intensity $I_G$ of the main Raman band and peak intensity $I_D$ of the shoulder Raman band obtained by the curve fitting. An average value of three sets of measurements was used to evaluate the $sp^3$ content. Hereinafter, the evaluation results obtained in this way may be referred to collectively as "analysis values." Also, the high-humidity image deletion, wear resistance, image blur, optical sensitivity, pressure scars, and flaking of each electrophotographic photosensitive member were evaluated by the following methods.

(High-Humidity Image Deletion)

First, the electrophotographic photosensitive member was mounted on a modified version of an electrophotographic apparatus (iR5065 (trade name) made by Canon Inc.). The electrophotographic apparatus was modified so as to operate at a process speed of 500 mm/sec, use a laser source with an oscillation wavelength of 670 nm as image exposure light, and output images at a resolution of 1200 dpi. The produced electrophotographic photosensitive member was mounted on the electrophotographic apparatus and an A3-size full-page character chart (4 pt, 4% page-coverage rate) was printed on an platen in an environment of 22° C. temperature and 50% relative humidity. The photosensitive-member heater was turned on and initial images were printed with the surface of the electrophotographic photosensitive member kept at 40° C.

Subsequently, a continuous paper feed test was conducted. Specifically, with the photosensitive-member heater kept off, using an A4-size test pattern with a page-coverage rate of 1%, a continuous paper feed test was conducted by feeding 25,000 sheets per day for a cumulative total of up to 250,000 sheets. After the continuous paper feed test, the electrophotographic apparatus was left to stand for 15 hours in an environment of 25° C. temperature and 75% relative humidity. After 15 hours, the electrophotographic apparatus was started with the photosensitive-member heater kept off, and images were output using the same A3-size character chart as the one used in the initial image output. The images printed initially and the images printed after the continuous paper feed test were converted electronically into PDF files as 300-dpi monochrome binary data using electrophotographic apparatus iRC-5870 made by Canon Inc. The images in electronic format were processed using Adobe Photoshop (produced by Adobe Systems Incorporated) to measure the proportion of pixels displayed in black (hereinafter also referred to as "black percentage") in an image area (251.3 mm×273 mm) corresponding to the circumferential area of the electrophotographic photosensitive member. The black percentage thus measured was evaluated in terms of the ratio of the image printed after the continuous paper feed test to the images printed initially. With this evaluation method, the larger the numerical value, the less the high-humidity image deletion.

(Wear Resistance)

The wear resistance was evaluated as follows. Immediately after production, the layer thickness of the surface layer of each electrophotographic photosensitive member was measured at 18 spots in total, including 9 spots in the longitudinal direction across an arbitrary circumferential position of the electrophotographic photosensitive member and 9 spots in the longitudinal direction across a position rotated 180° from the arbitrary circumferential position, and an average value of the 18 spots was calculated. The 9 spots in the longitudinal direction were located at 0 mm, ±50 mm, ±90 mm, ±130 mm, and ±150 mm from the longitudinal center of the electrophotographic photosensitive member. Regarding the measurement method, the surface of the electrophotographic photosensitive member was vertically irradiated with a beam 2 mm in spot diameter, and spectrometric measurements of reflected light were taken using a spectrometer (MCPD-2000 made by Otuska Electronics Co., Ltd.). The layer thickness of the surface layer was calculated based on reflected waveforms obtained as a result of the irradiation. In so doing, the following values were used. The wavelength range was from 500 nm to 750 nm (both inclusive) and the refractive index of the photoconductive layer 13 was 3.30. Also, the values determined by the spectroscopic ellipsometry were used as refractive index of the intermediate layer and surface layer.

After the layer thickness was measured, the electrophotographic photosensitive member was mounted on the electrophotographic apparatus modified for use in the experiments, and a continuous paper feed test was conducted under the same conditions as in the evaluation of high-humidity image deletion, in a high-humidity environment of temperature 25° C. and 75% relative humidity. After the 250,000-sheet continuous paper feed test, the electrophotographic photosensitive member was taken out of the electrophotographic apparatus. Then, the layer thickness was measured at the same position as immediately after production and the layer thickness of the surface layer subjected to the continuous paper feed test was calculated in the same manner as immediately after the production. After that, a difference between average layer thicknesses of the surface layer immediately after the production and after the continuous paper feed test was determined to calculate the amount of wear caused by the feed of 250,000 sheets. With this evaluation method, the smaller the numerical value, the less the amount of wear.

(Image Blur)

First, tone data was created by equally dividing an entire tone range into 18 steps at a resolution of 1200 dpi, a line density of 170 lpi (170 lines per inch) and 45 degrees on an area tone dot screen. Tone steps were established by assigning a number to each tone, that is, 17 to the darkest tone, and 0 to the lightest tone. Next, the electrophotographic photosensitive member was mounted on the electrophotographic apparatus modified for use in the experiments, and the tone data was printed on a A3-size sheet in text mode. To avoid occurrence of high-humidity image deletion which could affect evaluation of image blur, the printout was produced in an environment of 22° C. temperature and 50% relative humidity with the surface of the electrophotographic photosensitive member kept at 40° C. by turning on the photosensitive-member heater. The image density of the resulting images was measured on a tone-by-tone basis using a reflection densitometer (X-Rite 504 Spectrodensitometer made by X-Rite Inc.). In the reflection density measurement, images were printed out on three sheets for each tone and an average value of densities thereof was taken as an evaluation value.

A correlation coefficient between the evaluation value thus obtained and each tone step was calculated, and a difference from a correlation coefficient of 1.00 was taken to represent image blur, where the correlation coefficient of 1.00 represents halftoning by which the reflection density of tones changes perfectly linearly. With this evaluation method, the smaller the numerical value, the less the image blur, and thus the closer to linearity the halftoning is.

(Optical Sensitivity)

The electrophotographic photosensitive member was mounted on the electrophotographic apparatus modified for use in the experiments. With image exposure turned off, a wire and a grid of a charger were each connected with a high-voltage power supply. A grid potential was set to 820 V. Then, a surface potential of the electrophotographic photosensitive member was set to 450 V by adjusting the current supplied to the wires of the charger. Next, being charged under the charging conditions described above, the electrophotographic photosensitive member was irradiated with image exposure light. The potential of the electrophotographic photosensitive member at the position of a developing device was set to 100 V by adjusting irradiation energy. The irradiation energy of the image exposure light required here was evaluated as the optical sensitivity. With this evaluation method, the smaller the numerical value, the higher the optical sensitivity.

(Pressure Scars)

Using a surface property tester (made by Shinto Scientific Co., Ltd., known by its brand name HEIDON), a curved diamond needle 0.8 mm in diameter was brought into contact with the surface of the electrophotographic photosensitive member by the application of a constant load. In this state, the diamond needle was moved along a generatrix (in the longitudinal direction) of the electrophotographic photosensitive member at a fixed speed of 50 mm/minute. The distance of movement was set to 10 mm although it may be set arbitrarily. This operation was repeated by changing the point of contact between the needle and electrophotographic photosensitive member and increasing the load applied to the diamond needle in increments of 5 g beginning with 50 g. The surface of the electrophotographic photosensitive member subjected to the surface property test was observed by a microscope to check for any scratch. Then, the electrophotographic photosensitive member was mounted on the electrophotographic apparatus, and images with a reflection density of 0.5 were printed using a manuscript with halftones printed thereon. The images thus printed were visually observed, and the minimum load at which the pressure scars became visible was compared among the images. With this evaluation method, the larger the numerical value, the less likely it is that pressure scars will occur.

(Flaking)

A crosshatch pattern was produced in an area of 50 mm×50 mm on the surface of the electrophotographic photosensitive member by making scratches 0.3 mm to 0.5 mm (both inclusive) wide with a diamond pen and thereby drawing 100 grid cells at a pitch of 5 mm. It is sufficient if the scratches are deep enough to strip off the surface layer. Such crosshatch patterns were drawn in random circumferential and axial locations of an electrophotographic photosensitive member, which was then designated as an electrophotographic photosensitive member for evaluation of flaking. The electrophotographic photosensitive member for evaluation of flaking was left to stand for 12 hours in an environment kept at a temperature of −50° C. and relative humidity of 70%. Then, the electrophotographic photosensitive member was moved immediately to an environment kept at a temperature of 80° C. and relative humidity of 30% and left to stand there for 2 hours. The above cycle was repeated five times, and then the electrophotographic photosensitive member for evaluation of flaking was put in tap water of 25° C. and left to stand there for 5 days.

After the above process, the electrophotographic photosensitive member for evaluation of flaking was observed visually. The number of grid cells in which flaking was observed even partially was counted visually and was used for evaluation of flaking. Flaking was rated as follows.

A: The number of grid cells with flaking was less than 5.

B: The number of grid cells with flaking was from 5 (inclusive) to 10 (exclusive).

C: The number of grid cells with flaking was from 10 (inclusive) to 30 (exclusive).

D: The number of grid cells with flaking was 30 or more.

If the above rating is B or more, the risk of flaking is reduced greatly in the use of the electrophotographic photosensitive member including transport. If the rating is A, it is considered that there is almost no risk of flaking. The results of the above evaluations are shown in Table 8 together with analysis values of the surface layer, and analysis values of the intermediate layer are shown in Table 9.

TABLE 8

| | | Com. ex. 2 | Com. ex. 1 | Ex. 1 | Ex. 2 | Ex. 3 | Ex. 4 |
|---|---|---|---|---|---|---|---|
| | | Layer formation condition No. | | | | | |
| | | 6 | 5 | 1 | 2 | 3 | 4 |
| Surface layer | Si atom density ($\times 10^{22}$ atoms/cm$^3$) | 1.81 | 1.61 | 1.72 | 1.81 | 1.84 | 1.94 |
| | C atom density ($\times 10^{22}$ atoms/cm$^3$) | 4.44 | 4.82 | 4.88 | 4.88 | 4.97 | 5.00 |
| | Si + C atom density ($\times 10^{22}$ atoms/cm$^3$) | 6.25 | 6.42 | 6.60 | 6.69 | 6.81 | 6.94 |
| | C/(Si + C) | 0.71 | 0.75 | 0.74 | 0.73 | 0.73 | 0.72 |
| | H atom density ($\times 10^{22}$ atoms/cm$^3$) | 4.00 | 5.25 | 4.98 | 5.26 | 4.73 | 4.82 |
| | H/(Si + C + H) | 0.39 | 0.45 | 0.43 | 0.44 | 0.41 | 0.41 |
| | $I_D/I_G$ | 0.70 | 0.69 | 0.69 | 0.67 | 0.62 | 0.61 |
| | Layer thickness (nm) | 498 | 491 | 495 | 490 | 499 | 489 |
| Intermediate layer | Region A layer thickness (nm) | 0 | 0 | 446 | 407 | 398 | 387 |
| | Dot A layer thickness (nm) | 67 | | | | | |
| | Dot B layer thickness (nm) | 186 | | | | | |
| High-humidity image deletion | | 0.64 | 0.88 | 0.99 | 1.00 | 1.07 | 1.10 |
| Wear resistance | | 1.75 | 1.40 | 1.03 | 1.00 | 0.89 | 0.84 |
| Image blur | | 0.95 | 1.10 | 0.68 | 1.00 | 1.05 | 0.79 |
| Optical sensitivity | | 1.00 | 0.99 | 1.00 | 1.00 | 1.02 | 1.01 |
| Pressure scars | | 0.67 | 0.70 | 1.03 | 1.00 | 1.03 | 1.03 |
| Flaking | | A | A | A | A | A | A |

TABLE 9

| | | Common to Examples 1 to 4 and Comparative examples 1 and 2 | | | | | Com. ex. 2 | Com. ex. 1 | Ex. 1 | Ex. 2 | Ex. 3 | Ex. 4 |
|---|---|---|---|---|---|---|---|---|---|---|---|---|
| | | Layer formation condition No. | | | | | | | | | | |
| | | Common to 1 to 6 | | | | | 6 | 5 | 1 | 2 | 3 | 4 |
| | Point | A | B | C | D | E | F | | | | | |
| Intermediate layer | Si atom density ($\times 10^{22}$ atoms/cm$^3$) | 4.38 | 3.43 | 2.86 | 1.76 | 1.76 | 1.75 | 1.68 | 1.79 | 1.88 | 1.96 | 1.91 |

TABLE 9-continued

| | Common to Examples 1 to 4 and Comparative examples 1 and 2 | | | | | Com. ex. 2 | Com. ex. 1 | Ex. 1 | Ex. 2 | Ex. 3 | Ex. 4 |
|---|---|---|---|---|---|---|---|---|---|---|---|
| | Layer formation condition No. | | | | | | | | | | |
| | Common to 1 to 6 | | | | | 6 | 5 | 1 | 2 | 3 | 4 |
| Point | A | B | C | D | E | | | F | | | |
| C atom density ($\times 10^{22}$ atoms/cm$^3$) | 0.00 | 1.47 | 2.44 | 4.10 | 4.10 | 4.30 | 4.54 | 4.59 | 4.60 | 4.56 | 4.67 |
| Si + C atom density ($\times 10^{22}$ atoms/cm$^3$) | 4.38 | 4.90 | 5.30 | 5.86 | 5.86 | 6.05 | 6.22 | 6.38 | 6.48 | 6.52 | 6.58 |
| C/(Si + C) | 0.00 | 0.30 | 0.46 | 0.70 | 0.70 | 0.71 | 0.73 | 0.72 | 0.71 | 0.70 | 0.71 |
| H atom density ($\times 10^{22}$ atoms/cm$^3$) | 1.31 | 2.20 | 2.98 | 3.91 | 3.91 | 4.56 | 4.69 | 4.62 | 4.89 | 4.35 | 4.39 |
| H/(Si + C + H) | 0.23 | 0.31 | 0.36 | 0.40 | 0.40 | 0.43 | 0.43 | 0.42 | 0.43 | 0.40 | 0.40 |

Figure 6:
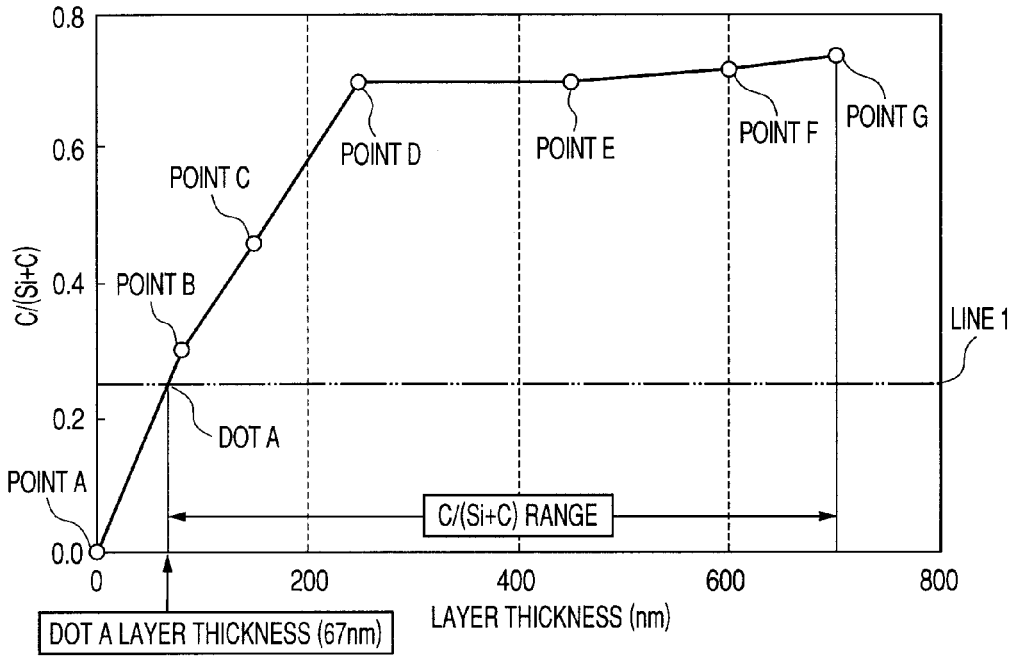
FIG. 6 is a diagram showing C/(Si+C) distribution and dot A layer thickness in the intermediate layer according to the present invention.
Figure 7:
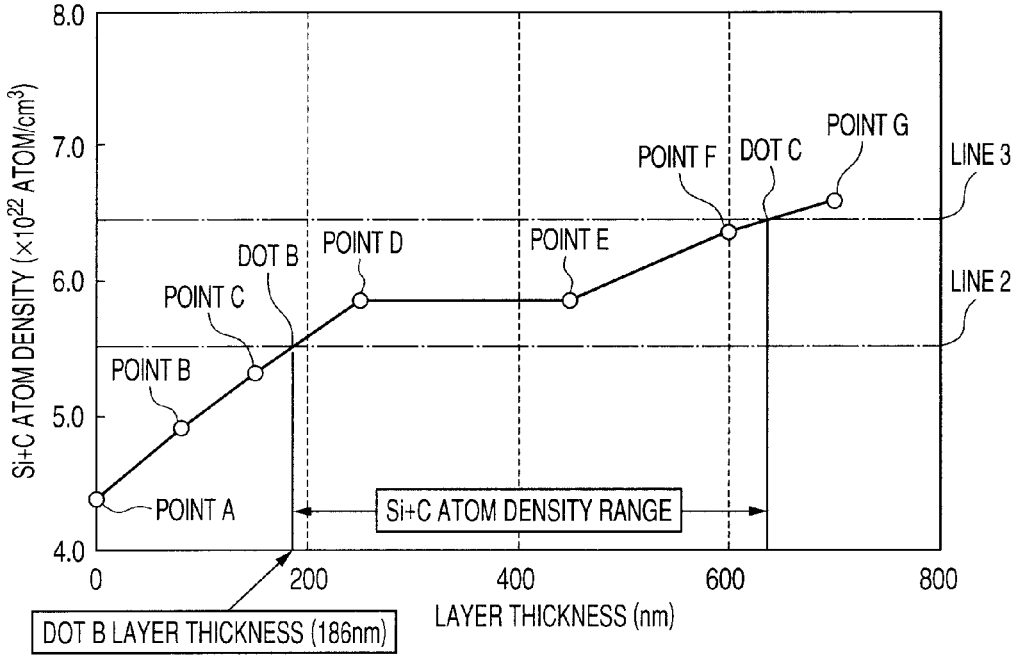
FIG. 7 is a diagram showing Si+C atom density distribution and dot B layer thickness in the intermediate layer according to the present invention.

In Table 8, the thickness of the intermediate layer is represented by the thickness of region A described above. A calculation method for dot A layer thickness is shown in FIG. 6. That is, values of C/(Si+C) at points A to G were plotted and in-between values were linearly interpolated. The intersection point of the interpolated line with line 1 which represented C/(Si+C)=0.25 was determined and designated as dot A. Then, the layer thickness at dot A was calculated. In FIG. 6, the range from dot A to point G is a region which satisfies the range of C/(Si+C) according to the present invention, and illustrated as C/(Si+C) range. A calculation method for dot B layer thickness is shown in FIG. 7. As in the case of FIG. 6, values of Si+C atom density at points A to G were plotted and in-between values were linearly interpolated. The intersection point of the interpolated line with line 2 which represented Si+C atom density=$5.50\times10^{22}$ atoms/cm$^3$ was determined and designated as dot B. Then, the layer thickness at dot B was calculated. At the same time, the intersection point of the interpolated line with line 3 which represented Si+C atom density=$6.45\times10^{22}$ atoms/cm$^3$ was determined and designated as dot C, and the layer thickness at dot C was calculated. In FIG. 7, the range from dot B to dot C is a region which satisfies the range of Si+C atom density according to the present invention, and illustrated as Si+C atom density range. In Table 8, the dot A layer thickness and the dot B layer thickness are same layer formation conditions, and so is represented by a single numerical value. Also, in Table 9, point G was formed under the same conditions as the surface layer and thus analysis values thereof are omitted. The high-humidity image deletion, wear resistance, image blur, optical sensitivity, and pressure scars are evaluated relative to the respective values of Example 2.

In the relative evaluation described above, regarding the high-humidity image deletion, a value of 0.60 or more means that there is no practical problem in actual use, 0.95 or more means superior resistance to high-humidity image deletion, and 1.02 or more means especially superior resistance to high-humidity image deletion. Regarding the wear resistance, a value of 1.90 or less means that there is no practical problem in actual use, 1.10 or less means superior wear resistance, and 0.90 or less means especially superior wear resistance. Regarding the image blur, a value of 2.30 or less means that almost all copied images provide tonality which has no practical problem in actual use, and 1.50 or less means especially superior tonality. A value of 1.50 or less means that image blur is substantially imperceptible in images, and the value falls within the range of measurement variations.

Regarding the optical sensitivity, a value of 1.55 or less means that there is no practical problem in actual use, 1.15 or less means good characteristics, and 1.10 or less means excellent characteristics applicable to a wide variety of electrophotographic processes. Regarding the pressure scars, a value of 0.50 or more means that there is no practical problem in actual use, and 0.95 or more means excellent characteristics which involve very low probability of occurrence of pressure scars. It can be seen from the results shown in Table 8 that the resistance to high-humidity image deletion and wear resistance are improved if the Si+C atom density of the surface layer is kept to or more $6.60\times10^{22}$ atoms/cm$^3$. The wear resistance is improved remarkably if the Si+C atom density is kept to or more $6.81\times10^{22}$ atoms/cm$^3$. On the other hand, the electrophotographic photosensitive members in comparative examples 1 and 2 have low evaluations for resistance to pressure scars because of the low Si+C atom density of the surface layer.

Examples 5 to 7 and Comparative Examples 3 and 4

Electrophotographic photosensitive members were produced in a manner similar to example 1. The formation conditions (layer formation conditions) of the intermediate layer and surface layer are shown in Tables 10 to 14.

TABLE 10

| | Example 5 (layer formation condition 7) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 320 | 180 | 50 | 50 | 42 | 35 | 35 |
| $CH_4$ [mL/min (normal)] | 0 | 150 | 300 | 455 | 455 | 320 | 190 | 190 |
| Internal pressure [Pa] | 95 | 95 | 95 | 95 | 95 | 80 | 70 | 70 |

TABLE 10-continued

| | Example 5 (layer formation condition 7) | | | | | | | |
|---|---|---|---|---|---|---|---|---|
| | Intermediate layer | | | | | | | Surface |
| | A | B | C | D | E | F | G | layer |
| High-frequency power [W] | 350 | 330 | 315 | 300 | 300 | 525 | 750 | 750 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 11

| | Example 6 (layer formation condition 8) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 320 | 180 | 50 | 50 | 40 | 26 | 26 |
| $CH_4$ [mL/min (normal)] | 0 | 150 | 300 | 455 | 455 | 320 | 190 | 190 |
| Internal pressure [Pa] | 95 | 95 | 95 | 95 | 95 | 80 | 70 | 70 |
| High-frequency power [W] | 350 | 330 | 315 | 300 | 300 | 500 | 700 | 700 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 12

| | Example 7 (layer formation condition 9) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 320 | 180 | 50 | 50 | 33 | 15 | 15 |
| $CH_4$ [mL/min (normal)] | 0 | 150 | 300 | 455 | 455 | 430 | 400 | 400 |
| Internal pressure [Pa] | 95 | 95 | 95 | 95 | 95 | 80 | 70 | 70 |
| High-frequency power [W] | 350 | 330 | 315 | 300 | 300 | 600 | 900 | 900 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 13

| | Comparative example 3 (layer formation condition 10) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 320 | 180 | 50 | 50 | 43 | 35 | 35 |
| $CH_4$ [mL/min (normal)] | 0 | 150 | 300 | 455 | 455 | 320 | 190 | 190 |
| Internal pressure [Pa] | 95 | 95 | 95 | 95 | 95 | 80 | 70 | 70 |
| High-frequency power [W] | 350 | 330 | 315 | 300 | 300 | 500 | 700 | 700 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 14

| | Comparative example 4 (layer formation condition 11) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 320 | 180 | 50 | 50 | 30 | 12 | 12 |
| $CH_4$ [mL/min (normal)] | 0 | 150 | 300 | 455 | 455 | 475 | 500 | 500 |
| Internal pressure [Pa] | 95 | 95 | 95 | 95 | 95 | 80 | 70 | 70 |
| High-frequency power [W] | 350 | 330 | 315 | 300 | 300 | 600 | 900 | 900 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

The electrophotographic photosensitive members produced under the above conditions were evaluated in the same manner as in example 1, and the results are shown in Table 15 together with analysis values of the surface layers and analysis values of the intermediate layers are shown in Table 16 in the same manner as in examples 1 to 4.

TABLE 15

| | | Com. ex. 3 | Ex. 5 | Ex. 6 | Ex. 7 | Com. ex. 4 |
|---|---|---|---|---|---|---|
| | | Layer formation condition No. | | | | |
| | | 10 | 7 | 8 | 9 | 11 |
| Surface layer | Si atom density ($\times 10^{22}$ atoms/cm$^3$) | 3.01 | 2.89 | 2.58 | 1.76 | 1.52 |
| | C atom density ($\times 10^{22}$ atoms/cm$^3$) | 4.34 | 4.51 | 4.80 | 5.27 | 5.40 |
| | Si + C atom density ($\times 10^{22}$ atoms/cm$^3$) | 7.35 | 7.4 | 7.38 | 7.02 | 6.92 |
| | C/(Si + C) | 0.59 | 0.61 | 0.65 | 0.75 | 0.78 |
| | H atom density ($\times 10^{22}$ atoms/cm$^3$) | 3.46 | 3.32 | 3.32 | 3.95 | 4.42 |
| | H/(Si + C + H) | 0.32 | 0.31 | 0.31 | 0.36 | 0.39 |
| | $I_D/I_G$ ratio | 0.54 | 0.52 | 0.58 | 0.63 | 0.69 |
| | Layer thickness (nm) | 485 | 491 | 493 | 493 | 498 |
| Intermediate layer | Region A layer thickness (nm) | 305 | 300 | 304 | 315 | 315 |
| | Dot A layer thickness (nm) | | | 131 | | |
| | Dot B layer thickness (nm) | | | 135 | | |
| High-humidity image deletion | | 1.10 | 1.11 | 1.11 | 1.09 | 1.06 |
| Wear resistance | | 0.81 | 0.79 | 0.81 | 0.83 | 0.84 |
| Image blur | | 1.68 | 1.32 | 1.11 | 1.05 | 0.84 |
| Optical sensitivity | | 1.15 | 0.99 | 0.98 | 1.00 | 1.12 |
| Pressure scars | | 1.03 | 1.03 | 1.00 | 1.03 | 1.03 |
| Flaking | | A | A | A | A | A |

TABLE 16

| | | Common to examples 5 to 7 and Comparative examples 3 and 4 | | | | | Com. ex. 3 | Ex. 5 | Ex. 6 | Ex. 7 | Com. ex. 4 |
|---|---|---|---|---|---|---|---|---|---|---|---|
| | | layer formation condition No. | | | | | | | | | |
| | | Common to 7 to 11 | | | | | 10 | 7 | 8 | 9 | 11 |
| | Point | A | B | C | D | E | | | F | | |
| Intermediate layer | Si atom density ($\times 10^{22}$ atoms/cm$^3$) | 4.38 | 4.49 | 3.93 | 2.41 | 2.41 | 2.68 | 2.70 | 2.49 | 2.33 | 2.13 |
| | C atom density ($\times 10^{22}$ atoms/cm$^3$) | 0.00 | 0.61 | 1.68 | 3.77 | 3.77 | 4.03 | 4.05 | 4.23 | 4.32 | 4.52 |
| | Si + C atom density ($\times 10^{22}$ atoms/cm$^3$) | 4.38 | 5.10 | 5.61 | 6.18 | 6.18 | 6.71 | 6.75 | 6.72 | 6.65 | 6.65 |

TABLE 16-continued

| | Common to examples 5 to 7 and Comparative examples 3 and 4 | | | | | Com. ex. 3 | Ex. 5 | Ex. 6 | Ex. 7 | Com. ex. 4 |
|---|---|---|---|---|---|---|---|---|---|---|
| | layer formation condition No. | | | | | | | | | |
| | Common to 7 to 11 | | | | | 10 | 7 | 8 | 9 | 11 |
| Point | A | B | C | D | E | | | F | | |
| C/(Si + C) | 0.00 | 0.12 | 0.30 | 0.61 | 0.61 | 0.60 | 0.60 | 0.63 | 0.65 | 0.68 |
| H atom density ($\times 10^{22}$ atoms/cm$^3$) | 1.31 | 1.61 | 2.18 | 4.29 | 4.29 | 3.77 | 4.14 | 4.87 | 5.02 | 4.62 |
| H/(Si + C + H) | 0.23 | 0.24 | 0.28 | 0.41 | 0.41 | 0.36 | 0.38 | 0.42 | 0.43 | 0.41 |

It can be seen from the results shown in Tables 15 and 16 that when the C/(Si+C) ratio of the surface layer is between 0.61 and 0.75 (both inclusive), good characteristics are available, realizing both reduced image blur and high optical sensitivity simultaneously. The low optical sensitivity in comparative example 3 is because the intermediate layer contains a part in which C/(Si+C) is higher than C/(Si+C) of the surface layer.

Example 8 to 10 and Comparative Examples 5 and 6

Electrophotographic photosensitive members were produced in a manner similar to example 1. The formation conditions (layer formation conditions) of the intermediate layer and surface layer are shown in Tables 17 to 21.

TABLE 17

| | Example 8 (layer formation condition 12) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 190 | 125 | 65 | 65 | 45 | 26 | 26 |
| $CH_4$ [mL/min (normal)] | 0 | 700 | 875 | 1050 | 1050 | 780 | 500 | 500 |
| Internal pressure [Pa] | 95 | 95 | 95 | 95 | 95 | 85 | 80 | 80 |
| High-frequency power [W] | 350 | 380 | 390 | 400 | 400 | 500 | 600 | 600 |
| Temperature of substrate [° C.] | 290 | 290 | 290 | 290 | 290 | 290 | 290 | 290 |
| Layer thickness [nm] | 0 | 80 | 160 | 250 | 450 | 600 | 650 | 500 |

TABLE 18

| | Example 9 (layer formation condition 13) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 250 | 150 | 50 | 50 | 40 | 26 | 26 |
| $CH_4$ [mL/min (normal)] | 0 | 375 | 565 | 750 | 750 | 650 | 500 | 500 |
| Internal pressure [Pa] | 95 | 95 | 95 | 95 | 95 | 85 | 80 | 80 |
| High-frequency power [W] | 350 | 380 | 390 | 400 | 400 | 500 | 600 | 600 |
| Temperature of substrate [° C.] | 290 | 290 | 290 | 290 | 290 | 290 | 290 | 290 |
| Layer thickness [nm] | 0 | 80 | 160 | 250 | 450 | 600 | 650 | 500 |

TABLE 19

| | Example 10 (layer formation condition 14) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 240 | 130 | 26 | 26 | 26 | 26 | 26 |
| $CH_4$ [mL/min (normal)] | 0 | 275 | 405 | 550 | 550 | 525 | 500 | 500 |
| Internal pressure [Pa] | 95 | 95 | 95 | 95 | 95 | 90 | 80 | 80 |
| High-frequency power [W] | 350 | 400 | 425 | 450 | 450 | 530 | 600 | 600 |

TABLE 19-continued

| | Example 10 (layer formation condition 14) | | | | | | | |
|---|---|---|---|---|---|---|---|---|
| | Intermediate layer | | | | | | | Surface |
| | A | B | C | D | E | F | G | layer |
| Temperature of substrate [° C.] | 290 | 290 | 290 | 290 | 290 | 290 | 290 | 290 |
| Layer thickness [nm] | 0 | 80 | 160 | 250 | 450 | 600 | 650 | 500 |

TABLE 20

| | Comparative example 5 (layer formation condition 15) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 320 | 190 | 65 | 65 | 45 | 26 | 26 |
| $CH_4$ [mL/min (normal)] | 0 | 350 | 700 | 1050 | 1050 | 780 | 500 | 500 |
| Internal pressure [Pa] | 95 | 95 | 95 | 95 | 95 | 90 | 80 | 80 |
| High-frequency power [W] | 350 | 330 | 315 | 300 | 300 | 450 | 600 | 600 |
| Temperature of substrate [° C.] | 290 | 290 | 290 | 290 | 290 | 290 | 290 | 290 |
| Layer thickness [nm] | 0 | 80 | 160 | 250 | 450 | 600 | 650 | 500 |

TABLE 21

| | Comparative example 6 (layer formation condition 16) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 310 | 170 | 35 | 35 | 30 | 26 | 26 |
| $CH_4$ [mL/min (normal)] | 0 | 150 | 300 | 450 | 450 | 475 | 500 | 500 |
| Internal pressure [Pa] | 95 | 95 | 95 | 95 | 95 | 90 | 80 | 80 |
| High-frequency power [W] | 350 | 420 | 480 | 550 | 550 | 580 | 600 | 600 |
| Temperature of substrate [° C.] | 290 | 290 | 290 | 290 | 290 | 290 | 290 | 290 |
| Layer thickness [nm] | 0 | 80 | 160 | 250 | 450 | 600 | 650 | 500 |

Comparative Example 7

An electrophotographic photosensitive member was produced in a manner similar to example 1 using the same surface layer as examples 8 to 10, but without forming the intermediate layer. Then the electrophotographic photosensitive member was evaluated. The layer thickness of the surface layer was 250 nm larger than the layer thickness of the surface layer in examples 8 to 10 (where the additional thickness of 250 nm corresponds to the region A of the intermediate layer).

Comparative Example 8

An electrophotographic photosensitive member was produced that C1 and D1 were fixed to under the condition of point D of the comparative example 5 and the intermediate layer was formed to a layer thickness of 400 nm without a transition region.

TABLE 22

| | | Com. ex. 5 | Ex. 8 | Ex. 9 | Ex. 10 | Com. ex. 6 | Com. ex. 7 | Com. ex. 8 |
|---|---|---|---|---|---|---|---|---|
| | | Layer formation condition No. | | | | | | |
| | | 15 | 12 | 13 | 14 | 16 | 17 | — |
| Surface layer | Si atom density ($\times 10^{22}$ atoms/cm$^3$) | 1.78 | 1.72 | 1.65 | 1.65 | 1.78 | 1.72 | 1.72 |
| | C atom density ($\times 10^{22}$ atoms/cm$^3$) | 4.82 | 4.88 | 4.95 | 4.96 | 4.83 | 4.88 | 4.89 |
| | Si + C atom density ($\times 10^{22}$ atoms/cm$^3$) | 6.60 | 6.60 | 6.60 | 6.61 | 6.61 | 6.60 | 6.61 |

TABLE 22-continued

| | | Com. ex. 5 | Ex. 8 | Ex. 9 | Ex. 10 | Com. ex. 6 | Com. ex. 7 | Com. ex. 8 |
|---|---|---|---|---|---|---|---|---|
| | | Layer formation condition No. | | | | | | |
| | | 15 | 12 | 13 | 14 | 16 | 17 | — |
| | C/(Si + C) | 0.73 | 0.74 | 0.75 | 0.75 | 0.73 | 0.74 | 0.74 |
| | H atom density ($\times 10^{22}$ atoms/cm$^3$) | 4.78 | 4.98 | 5.19 | 4.99 | 4.79 | 4.98 | 4.99 |
| | H/(Si + C + H) | 0.42 | 0.43 | 0.44 | 0.43 | 0.42 | 0.43 | 0.43 |
| | $I_D/I_G$ | 0.69 | 0.67 | 0.69 | 0.68 | 0.69 | 0.69 | 0.68 |
| | Layer thickness (nm) | 485 | 495 | 490 | 501 | 498 | 752 | 487 |
| Intermediate layer | Si atom density ($\times 10^{22}$ atoms/cm$^3$) | 1.51 | 1.54 | 1.78 | 1.67 | 2.04 | — | 1.51 |
| | C atom density ($\times 10^{22}$ atoms/cm$^3$) | 3.69 | 3.97 | 4.37 | 4.77 | 4.54 | — | 3.69 |
| | Si + C atom density ($\times 10^{22}$ atoms/cm$^3$) | 5.20 | 5.51 | 6.15 | 6.44 | 6.58 | — | 5.20 |
| | C/(Si + C) | 0.71 | 0.72 | 0.71 | 0.74 | 0.69 | — | 0.71 |
| | H atom density ($\times 10^{22}$ atoms/cm$^3$) | 3.61 | 3.52 | 4.10 | 4.12 | 4.03 | — | 3.61 |
| | H/(Si + C + H) | 0.41 | 0.39 | 0.40 | 0.39 | 0.38 | — | 0.41 |
| | Region A layer thickness(nm) | 136 | 418 | 518 | 339 | 83 | — | 0 |
| | Dot A layer thickness(nm) | 136 | 65 | 80 | 110 | 140 | — | — |
| | Dot B layer thickness(nm) | 497 | 243 | 82 | 130 | 88 | — | — |
| | High-humidity image deletion | 0.97 | 0.99 | 1.00 | 0.99 | 0.97 | 0.97 | 1.00 |
| | Wear resistance | 1.05 | 1.03 | 1.00 | 1.08 | 1.08 | 1.05 | 1.06 |
| | Image blur | 0.79 | 0.58 | 0.68 | 0.89 | 1.82 | 0.84 | 0.89 |
| | Optical sensitivity | 1.01 | 1.01 | 1.01 | 1.02 | 1.00 | 1.02 | 1.00 |
| | Pressure scars | 0.93 | 1.03 | 1.03 | 1.00 | 0.73 | 0.70 | 0.70 |
| | Flaking | B | A | A | A | A | C | C |

In Table 22, the analysis values of the intermediate layer are represented by those of point D under respective layer formation conditions. Details of the analysis values of the intermediate layer are shown in Tables 23 and 24.

TABLE 23

| | Example 8 | | | | | | |
|---|---|---|---|---|---|---|---|
| | | Layer formation condition No. 12 | | | | | |
| | Point | A | B | C | D | E | F |
| Intermediate layer | Si atom density ($\times 10^{22}$ atoms/cm$^3$) | 4.38 | 3.55 | 2.95 | 1.54 | 1.54 | 1.68 |
| | C atom density ($\times 10^{22}$ atoms/cm$^3$) | 0.00 | 1.60 | 2.41 | 3.97 | 3.97 | 4.55 |
| | Si + C atom density ($\times 10^{22}$ atoms/cm$^3$) | 4.38 | 5.15 | 5.36 | 5.51 | 5.51 | 6.23 |
| | C/(Si + C) | 0.00 | 0.31 | 0.45 | 0.72 | 0.72 | 0.73 |
| | H atom density ($\times 10^{22}$ atoms/cm$^3$) | 1.31 | 2.54 | 3.15 | 3.52 | 3.52 | 4.33 |
| | H/(Si + C + H) | 0.23 | 0.33 | 0.37 | 0.39 | 0.39 | 0.41 |

| | Example 9 | | | | | | |
|---|---|---|---|---|---|---|---|
| | | Layer formation condition No. 13 | | | | | |
| | Point | A | B | C | D | E | F |
| Intermediate layer | Si atom density ($\times 10^{22}$ atoms/cm$^3$) | 4.38 | 4.11 | 3.31 | 1.78 | 1.78 | 1.81 |
| | C atom density ($\times 10^{22}$ atoms/cm$^3$) | 0.00 | 1.37 | 2.50 | 4.37 | 4.37 | 4.64 |
| | Si + C atom density ($\times 10^{22}$ atoms/cm$^3$) | 4.38 | 5.48 | 5.81 | 6.15 | 6.15 | 6.45 |
| | C/(Si + C) | 0.00 | 0.25 | 0.43 | 0.71 | 0.71 | 0.72 |
| | H atom density ($\times 10^{22}$ atoms/cm$^3$) | 1.31 | 2.24 | 2.73 | 4.10 | 4.10 | 4.67 |
| | H/(Si + C + H) | 0.23 | 0.29 | 0.32 | 0.40 | 0.40 | 0.42 |

TABLE 23-continued

| | Example 10 | | | | | | |
|---|---|---|---|---|---|---|---|
| | | Layer formation condition No. 14 | | | | | |
| | Point | A | B | C | D | E | F |
| Intermediate layer | Si atom density ($\times 10^{22}$ atoms/cm$^3$) | 4.38 | 4.17 | 3.59 | 1.67 | 1.67 | 1.70 |
| | C atom density ($\times 10^{22}$ atoms/cm$^3$) | 0.00 | 0.82 | 2.20 | 4.77 | 4.77 | 4.82 |
| | Si + C atom density ($\times 10^{22}$ atoms/cm$^3$) | 4.38 | 5.02 | 5.79 | 6.44 | 6.44 | 6.52 |
| | C/(Si + C) | 0.00 | 0.17 | 0.38 | 0.74 | 0.74 | 0.74 |
| | H atom density ($\times 10^{22}$ atoms/cm$^3$) | 1.31 | 1.86 | 2.60 | 4.12 | 4.12 | 4.53 |
| | H/(Si + C + H) | 0.23 | 0.27 | 0.31 | 0.39 | 0.39 | 0.41 |

TABLE 24

| | Comparative example 5 | | | | | | |
|---|---|---|---|---|---|---|---|
| | | Layer formation condition No. 15 | | | | | |
| | Point | A | B | C | D | E | F |
| Intermediate layer | Si atom density ($\times 10^{22}$ atoms/cm$^3$) | 4.38 | 4.01 | 3.40 | 1.51 | 1.51 | 1.66 |
| | C atom density ($\times 10^{22}$ atoms/cm$^3$) | 0.00 | 0.60 | 1.46 | 3.69 | 3.69 | 4.49 |

TABLE 24-continued

| | | | | | | | |
|---|---|---|---|---|---|---|---|
| | Si + C atom density ($\times 10^{22}$ atoms/cm$^3$) | 4.38 | 4.61 | 4.85 | 5.20 | 5.20 | 6.15 |
| | C/(Si + C) | 0.00 | 0.13 | 0.30 | 0.71 | 0.71 | 0.73 |
| | H atom density ($\times 10^{22}$ atoms/cm$^3$) | 1.31 | 2.17 | 2.73 | 3.61 | 3.61 | 4.45 |
| | H/(Si + C + H) | 0.23 | 0.32 | 0.36 | 0.41 | 0.41 | 0.42 |

| | Comparative example 6 | | | | | | |
|---|---|---|---|---|---|---|---|
| | | Layer formation condition No. 16 | | | | | |
| | Point | A | B | C | D | E | F |
| Inter-mediate layer | Si atom density ($\times 10^{22}$ atoms/cm$^3$) | 4.38 | 4.98 | 4.75 | 2.04 | 2.04 | 1.84 |
| | C atom density ($\times 10^{22}$ atoms/cm$^3$) | 0.00 | 0.43 | 1.26 | 4.54 | 4.54 | 4.74 |
| | Si + C atom density ($\times 10^{22}$ atoms/cm$^3$) | 4.38 | 5.41 | 6.01 | 6.58 | 6.58 | 6.58 |
| | C/(Si + C) | 0.00 | 0.08 | 0.21 | 0.69 | 0.69 | 0.72 |
| | H atom density ($\times 10^{22}$ atoms/cm$^3$) | 1.31 | 2.10 | 3.10 | 4.03 | 4.03 | 4.39 |
| | H/(Si + C + H) | 0.23 | 0.28 | 0.34 | 0.38 | 0.38 | 0.40 |

As shown in Table 22, in comparative examples 5 and 6, specific regions with Si+C atom densities of $5.20\times10^{22}$ atoms/cm$^3$ and $6.58\times10^{22}$ atoms/cm$^3$, respectively, and with the thickness of 200 nm were provided between point D and point E, but neither provided a sufficient pressure scars prevention effect. This is because in both comparative examples 5 and 6, the layer thickness of region A is less than 150 nm, reducing the pressure scars prevention effect. This also means that under such circumstances, even if a region of a fixed layer thickness is provided in a range in which the Si+C atom density falls outside the range of $5.50\times10^{22}$ atoms/cm$^3$ and $6.45\times10^{22}$ atoms/cm$^3$ (both inclusive), a sufficient pressure scars prevention effect is not available. Also, comparative examples 7 and 8, in which either no intermediate layer was formed or the intermediate layer was formed without a transition region, did not provide a sufficient flaking prevention effect. Thus, it can be seen that in order to prevent pressure scars, a region whose Si+C atom density is between $5.50\times10^{22}$ atoms/cm$^3$ and $6.45\times10^{22}$ atoms/cm$^3$ (both inclusive) needs to be 150 nm thick or more.

Example 11 to 13 and Comparative Examples 9 and 10

An electrophotographic photosensitive member was produced in a manner similar to example 1. The formation conditions (layer formation conditions) of the intermediate layer and surface layer are shown in Tables 25 to 29.

TABLE 25

| | Example 11 (layer formation condition 18) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 315 | 185 | 50 | 50 | 35 | 15 | 15 |
| $CH_4$ [mL/min (normal)] | 0 | 100 | 200 | 300 | 300 | 350 | 400 | 400 |
| Internal pressure [Pa] | 80 | 80 | 85 | 95 | 95 | 80 | 70 | 70 |
| High-frequency power [W] | 350 | 315 | 285 | 250 | 250 | 570 | 900 | 900 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 26

| | Example 11 (layer formation condition 18) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 300 | 170 | 50 | 50 | 35 | 15 | 15 |
| $CH_4$ [mL/min (normal)] | 0 | 250 | 500 | 750 | 750 | 580 | 400 | 400 |
| Internal pressure [Pa] | 80 | 80 | 85 | 95 | 95 | 80 | 70 | 70 |
| High-frequency power [W] | 350 | 390 | 430 | 480 | 480 | 700 | 900 | 900 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 27

| | Example 13 (layer formation condition 20) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 300 | 170 | 50 | 50 | 30 | 15 | 15 |
| $CH_4$ [mL/min (normal)] | 0 | 350 | 700 | 1035 | 1035 | 720 | 400 | 400 |

TABLE 27-continued

| | Example 13 (layer formation condition 20) | | | | | | | |
|---|---|---|---|---|---|---|---|---|
| | Intermediate layer | | | | | | | Surface layer |
| | A | B | C | D | E | F | G | |
| Internal pressure [Pa] | 80 | 80 | 85 | 95 | 95 | 80 | 70 | 70 |
| High-frequency power [W] | 350 | 430 | 520 | 600 | 600 | 750 | 900 | 900 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 28

| | Comparative example 9 (layer formation condition 21) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 320 | 185 | 50 | 50 | 30 | 15 | 15 |
| $CH_4$ [mL/min (normal)] | 0 | 100 | 200 | 300 | 300 | 350 | 400 | 400 |
| Internal pressure [Pa] | 80 | 80 | 85 | 95 | 95 | 80 | 70 | 70 |
| High-frequency power [W] | 350 | 300 | 250 | 200 | 200 | 600 | 900 | 900 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 29

| | Comparative example 10 (layer formation condition 22) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 310 | 190 | 50 | 50 | 33 | 15 | 15 |
| $CH_4$ [mL/min (normal)] | 0 | 500 | 1000 | 1500 | 1500 | 950 | 400 | 400 |
| Internal pressure [Pa] | 80 | 80 | 85 | 95 | 95 | 80 | 70 | 70 |
| High-frequency power [W] | 350 | 530 | 720 | 900 | 900 | 900 | 900 | 900 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

The electrophotographic photosensitive members described above were evaluated in the same manner as in example 1 and results are shown in Table 30 together with analysis values of the surface layers in the same manner as in examples 1 to 4.

TABLE 30

| | | Com. ex. 9 | Ex. 11 | Ex. 12 | Ex. 13 | Com. ex. 10 |
|---|---|---|---|---|---|---|
| | | Layer formation condition No. | | | | |
| | | 21 | 18 | 19 | 20 | 22 |
| Surface layer | Si atom density ($\times 10^{22}$ atoms/cm$^3$) | 1.83 | 1.76 | 1.83 | 1.76 | 1.75 |
| | C atom density ($\times 10^{22}$ atoms/cm$^3$) | 5.20 | 5.27 | 5.20 | 5.27 | 5.26 |
| | Si + C atom density ($\times 10^{22}$ atoms/cm$^3$) | 7.03 | 7.02 | 7.03 | 7.02 | 7.01 |
| | C/(Si + C) | 0.74 | 0.75 | 0.74 | 0.75 | 0.75 |
| | H atom density ($\times 10^{22}$ atoms/cm$^3$) | 4.13 | 3.95 | 3.79 | 3.95 | 4.12 |

TABLE 30-continued

| | | Com. ex. 9 | Ex. 11 | Ex. 12 | Ex. 13 | Com. ex. 10 |
|---|---|---|---|---|---|---|
| | | Layer formation condition No. | | | | |
| | | 21 | 18 | 19 | 20 | 22 |
| | H/(Si + C + H) | 0.37 | 0.36 | 0.35 | 0.36 | 0.37 |
| | $I_D/I_G$ | 0.63 | 0.63 | 0.65 | 0.64 | 0.65 |
| | Layer thickness (nm) | 485 | 493 | 497 | 493 | 498 |
| Intermediate layer | Si atom density ($\times 10^{22}$ atoms/cm$^3$) | 2.73 | 2.92 | 1.87 | 1.54 | 1.30 |
| | C atom density ($\times 10^{22}$ atoms/cm$^3$) | 3.47 | 3.16 | 4.36 | 4.61 | 4.90 |
| | Si + C atom density ($\times 10^{22}$ atoms/cm$^3$) | 6.20 | 6.08 | 6.23 | 6.15 | 6.20 |
| | C/(Si + C) | 0.56 | 0.52 | 0.70 | 0.75 | 0.79 |
| | H atom density ($\times 10^{22}$ atoms/cm$^3$) | 4.13 | 4.23 | 4.15 | 4.45 | 4.68 |
| | H/(Si + C + H) | 0.40 | 0.41 | 0.40 | 0.42 | 0.43 |
| | Region A layer thickness(nm) | 353 | 405 | 405 | 445 | 470 |
| | Dot A layer thickness(nm) | 166 | 115 | 71 | 71 | 83 |
| | Dot B layer thickness(nm) | 165 | 124 | 131 | 123 | 94 |
| High-humidity image deletion | | 1.07 | 1.09 | 1.08 | 1.09 | 1.10 |
| Wear resistance | | 0.83 | 0.89 | 0.81 | 0.84 | 0.83 |
| Image blur | | 1.84 | 1.32 | 0.79 | 1.05 | 0.84 |
| Optical sensitivity | | 1.00 | 1.00 | 1.02 | 1.06 | 1.30 |
| Pressure scars | | 1.03 | 1.00 | 1.03 | 1.00 | 1.00 |
| Flaking | | A | A | A | A | A |

In Table 30, the analysis values of the intermediate layer are represented by those of point D under respective layer formation conditions. Details of the analysis values of the intermediate layer are shown in Tables 31 and 32.

TABLE 31

| | Example 11 | | | | | | |
|---|---|---|---|---|---|---|---|
| | | Layer formation condition No. 18 | | | | | |
| | Point | A | B | C | D | E | F |
| Intermediate layer | Si atom density ($\times 10^{22}$ atoms/cm$^3$) | 4.38 | 4.09 | 3.97 | 2.92 | 2.92 | 2.51 |
| | C atom density ($\times 10^{22}$ atoms/cm$^3$) | 0.00 | 0.96 | 1.79 | 3.16 | 3.16 | 4.27 |
| | Si + C atom density ($\times 10^{22}$ atoms/cm$^3$) | 4.38 | 5.05 | 5.76 | 6.08 | 6.08 | 6.78 |
| | C/(Si + C) | 0.00 | 0.19 | 0.31 | 0.52 | 0.52 | 0.63 |
| | H atom density ($\times 10^{22}$ atoms/cm$^3$) | 1.31 | 1.96 | 2.84 | 4.23 | 4.23 | 4.33 |
| | H/(Si + C + H) | 0.23 | 0.28 | 0.33 | 0.41 | 0.41 | 0.39 |

| | Example 12 | | | | | | |
|---|---|---|---|---|---|---|---|
| | | Layer formation condition No. 19 | | | | | |
| | Point | A | B | C | D | E | F |
| Intermediate layer | Si atom density ($\times 10^{22}$ atoms/cm$^3$) | 4.38 | 3.60 | 3.46 | 1.87 | 1.87 | 1.85 |
| | C atom density ($\times 10^{22}$ atoms/cm$^3$) | 0.00 | 1.40 | 2.22 | 4.36 | 4.36 | 4.76 |
| | Si + C atom density ($\times 10^{22}$ atoms/cm$^3$) | 4.38 | 5.00 | 5.68 | 6.23 | 6.23 | 6.61 |
| | C/(Si + C) | 0.00 | 0.28 | 0.39 | 0.70 | 0.70 | 0.72 |
| | H atom density ($\times 10^{22}$ atoms/cm$^3$) | 1.31 | 2.35 | 3.48 | 4.15 | 4.15 | 4.05 |
| | H/(Si + C + H) | 0.23 | 0.32 | 0.38 | 0.40 | 0.40 | 0.38 |

TABLE 31-continued

| | Example 13 | | | | | | |
|---|---|---|---|---|---|---|---|
| | | Layer formation condition No. 20 | | | | | |
| | Point | A | B | C | D | E | F |
| Intermediate layer | Si atom density ($\times 10^{22}$ atoms/cm$^3$) | 4.38 | 4.27 | 3.24 | 1.54 | 1.54 | 1.63 |
| | C atom density ($\times 10^{22}$ atoms/cm$^3$) | 0.00 | 0.94 | 2.44 | 4.61 | 4.61 | 4.90 |
| | Si + C atom density ($\times 10^{22}$ atoms/cm$^3$) | 4.38 | 5.21 | 5.68 | 6.15 | 6.15 | 6.53 |
| | C/(Si + C) | 0.00 | 0.18 | 0.43 | 0.75 | 0.75 | 0.75 |
| | H atom density ($\times 10^{22}$ atoms/cm$^3$) | 1.31 | 1.74 | 2.55 | 4.45 | 4.45 | 4.17 |
| | H/(Si + C + H) | 0.23 | 0.25 | 0.31 | 0.42 | 0.42 | 0.39 |

TABLE 32

| | Comparative example 9 | | | | | | |
|---|---|---|---|---|---|---|---|
| | | Layer formation condition No. 21 | | | | | |
| | Point | A | B | C | D | E | F |
| Intermediate layer | Si atom density ($\times 10^{22}$ atoms/cm$^3$) | 4.38 | 4.46 | 4.30 | 2.98 | 2.98 | 2.16 |
| | C atom density ($\times 10^{22}$ atoms/cm$^3$) | 0.00 | 0.39 | 1.08 | 3.22 | 3.22 | 4.59 |
| | Si + C atom density ($\times 10^{22}$ atoms/cm$^3$) | 4.38 | 4.85 | 5.38 | 6.20 | 6.20 | 6.75 |

TABLE 32-continued

| | | | | | | | |
|---|---|---|---|---|---|---|---|
| | C/(Si + C) | 0.00 | 0.08 | 0.20 | 0.52 | 0.52 | 0.68 |
| | H atom density ($\times 10^{22}$ atoms/cm$^3$) | 1.31 | 1.89 | 2.77 | 4.13 | 4.13 | 4.32 |
| | H/(Si + C + H) | 0.23 | 0.28 | 0.34 | 0.40 | 0.40 | 0.39 |

| | Comparative example 10 | | | | | | |
|---|---|---|---|---|---|---|---|
| | | Layer formation condition No. 22 | | | | | |
| | Point | A | B | C | D | E | F |
| Intermediate layer | Si atom density ($\times 10^{22}$ atoms/cm$^3$) | 4.38 | 4.06 | 3.11 | 1.30 | 1.30 | 1.44 |
| | C atom density ($\times 10^{22}$ atoms/cm$^3$) | 0.00 | 1.35 | 2.75 | 4.90 | 4.90 | 5.09 |
| | Si + C atom density ($\times 10^{22}$ atoms/cm$^3$) | 4.38 | 5.41 | 5.86 | 6.20 | 6.20 | 6.53 |
| | C/(Si + C) | 0.00 | 0.25 | 0.47 | 0.79 | 0.79 | 0.78 |
| | H atom density ($\times 10^{22}$ atoms/cm$^3$) | 1.31 | 2.91 | 3.75 | 4.68 | 4.68 | 4.54 |
| | H/(Si + C + H) | 0.23 | 0.35 | 0.39 | 0.43 | 0.43 | 0.41 |

From the results shown in Tables 30 to 32, an increase in image blur is observed in comparative example 9, in which the dot A layer thickness is larger than the dot B layer thickness. This is because C1 is less than 0.25 in part of the range in which D1 is between $5.50\times10^{22}$ atoms/cm$^3$ and $6.45\times10^{22}$ atoms/cm$^3$ (both inclusive). Also, a decrease in optical sensitivity is observed in comparative example 10, in which C1 of the intermediate layer is higher than C2 of the surface layer.

Examples 14 and 15 and Comparative Example 11

An electrophotographic photosensitive member was produced in a manner similar to example 1. The formation conditions (layer formation conditions) of the intermediate layer and surface layer are shown in Table 33.

TABLE 33

| | | | Intermediate layer | | | | | | | Surface |
|---|---|---|---|---|---|---|---|---|---|---|
| | | | A | B | C | D | E | F | G | layer |
| Gas types and flow rates | | | | | | | | | | |
| $SiH_4$ [mL/min (normal)] | | | 450 | 300 | 170 | 50 | 50 | 35 | 15 | 15 |
| $CH_4$ [mL/min (normal)] | | | 0 | 250 | 500 | 750 | 750 | 580 | 400 | 400 |
| Internal pressure [Pa] | | | 80 | 80 | 85 | 95 | 95 | 80 | 70 | 70 |
| High-frequency power [W] | | | 350 | 390 | 430 | 480 | 480 | 700 | 900 | 900 |
| Temperature of substrate [° C.] | | | 290 | 290 | 290 | 290 | 290 | 290 | 290 | 290 |
| Layer thickness [nm] | Com. ex. 11 | Layer formation condition 23 | 0 | 80 | 150 | 200 | 200 | 280 | 350 | 500 |
| | Ex. 14 | Layer formation condition 24 | 0 | 80 | 100 | 150 | 200 | 280 | 350 | 500 |
| | Ex. 15 | Layer formation condition 25 | 0 | 80 | 130 | 200 | 820 | 900 | 1000 | 500 |

Comparative Example 12

An electrophotographic photosensitive member was produced in a manner similar to example 1 except that the surface layer was the same as that of examples 14 and 15, that the intermediate layer was fixed to under the condition of point D of the example 14, and that a region in which C1 and D1 change continuously was not provided. The electrophotographic photosensitive member described above was evaluated in the same manner as in example 1 and results are shown in Table 34 together with analysis values of the surface layers in the same manner as in examples 1 to 4.

TABLE 34

| | | Com. ex. 11 | Ex. 14 | Ex. 15 | Com. ex. 12 |
|---|---|---|---|---|---|
| | | Layer formation condition No. | | | |
| | | 25 | 23 | 24 | — |
| Surface layer | Si atom density ($\times 10^{22}$ atoms/cm$^3$) | 1.83 | 1.89 | 1.76 | 1.90 |
| | C atom density ($\times 10^{22}$ atoms/cm$^3$) | 5.20 | 5.11 | 5.27 | 5.13 |
| | Si + C atom density ($\times 10^{22}$ atoms/cm$^3$) | 7.03 | 7.00 | 7.02 | 7.03 |
| | C/(Si + C) | 0.74 | 0.73 | 0.75 | 0.73 |
| | H atom density ($\times 10^{22}$ atoms/cm$^3$) | 3.79 | 3.94 | 3.78 | 3.79 |
| | H/(Si + C + H) | 0.35 | 0.36 | 0.35 | 0.35 |
| | $I_D/I_G$ | 0.65 | 0.68 | 0.65 | 0.67 |
| | Layer thickness (nm) | 497 | 481 | 489 | 490 |
| Intermediate layer | Si atom density ($\times 10^{22}$ atoms/cm$^3$) | 1.87 | | | |
| | C atom density ($\times 10^{22}$ atoms/cm$^3$) | 4.36 | | | |
| | Si + C atom density ($\times 10^{22}$ atoms/cm$^3$) | 6.23 | | | |
| | C/(Si + C) | 0.70 | | | |
| | H atom density ($\times 10^{22}$ atoms/cm$^3$) | 4.15 | | | |
| | H/(Si + C + H) | 0.40 | | | |

TABLE 34-continued

| | Com. ex. 11 | Ex. 14 | Ex. 15 | Com. ex. 12 |
|---|---|---|---|---|
| | Layer formation condition No. | | | |
| | 25 | 23 | 24 | — |
| Region A layer thickness(nm) | 115 | 152 | 750 | 500 |
| Dot A layer thickness(nm) | 106 | 87 | 98 | — |
| Dot B layer thickness(nm) | 131 | 95 | 117 | — |
| High-humidity image deletion | 1.07 | 1.09 | 1.08 | 1.09 |
| Wear resistance | 0.84 | 0.83 | 0.81 | 0.81 |
| Image blur | 0.89 | 0.79 | 0.79 | 1.00 |
| Optical sensitivity | 1.02 | 1.02 | 1.04 | 1.02 |

TABLE 34-continued

| | Com. ex. 11 | Ex. 14 | Ex. 15 | Com. ex. 12 |
|---|---|---|---|---|
| | Layer formation condition No. | | | |
| | 25 | 23 | 24 | — |
| Pressure scars | 0.93 | 0.97 | 1.03 | 1.03 |
| Flaking | A | A | A | C |

In Table 34, the analysis values of the intermediate layer are represented by those of point D. The analysis values of the surface layer are results of individual measurements taken using the procedures described above. Details of the analysis values of the intermediate layer are shown in Table 35.

TABLE 35

| | | Examples 14 and 15 and Comparative example 11 | | | | | | Com. ex. 12 |
|---|---|---|---|---|---|---|---|---|
| | | Layer formation condition No. 23-25 | | | | | | — |
| | Point | A | B | C | D | E | F | — |
| Intermediate layer | Si atom density ($\times 10^{22}$ atoms/cm$^3$) | 4.38 | 4.10 | 3.58 | 1.87 | 1.87 | 1.85 | 1.84 |
| | C atom density ($\times 10^{22}$ atoms/cm$^3$) | 0.00 | 0.90 | 2.10 | 4.36 | 4.36 | 4.76 | 4.39 |
| | Si + C atom density ($\times 10^{22}$ atoms/cm$^3$) | 4.38 | 5.00 | 5.68 | 6.23 | 6.23 | 6.61 | 6.23 |
| | C/(Si + C) | 0.00 | 0.18 | 0.37 | 0.70 | 0.70 | 0.72 | 0.71 |
| | H atom density ($\times 10^{22}$ atoms/cm$^3$) | 1.31 | 2.35 | 3.48 | 4.15 | 4.15 | 4.05 | 4.17 |
| | H/(Si + C + H) | 0.23 | 0.32 | 0.38 | 0.40 | 0.40 | 0.38 | 0.40 |

In Table 34, since the layer formation conditions of the intermediate layers at each point are common to the electrophotographic photosensitive members produced under layer formation conditions 23 to 25, values of the intermediate layers are represented by single value. It can be seen from the results shown in Tables 34 and 35 that a pressure scars prevention effect is obtained when region A is 150 nm thick or more. Also, the electrophotographic photosensitive members in examples 14 and 15 show improved resistance to flaking compared to comparative example 12.

Examples 16 to 20

Electrophotographic photosensitive members were produced in a manner similar to example 1. The formation conditions (layer formation conditions) of the intermediate layer and surface layer are shown in Tables 36 to 40.

TABLE 36

| | Example 16 (layer formation condition 26) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 315 | 185 | 50 | 50 | 38 | 26 | 26 |
| $H_2$ [mL/min (normal)] | 0 | 0 | 0 | 0 | 0 | 175 | 350 | 350 |
| $CH_4$ [mL/min (normal)] | 0 | 100 | 200 | 300 | 300 | 250 | 200 | 200 |
| Internal pressure [Pa] | 80 | 80 | 85 | 95 | 95 | 90 | 80 | 80 |
| High-frequency power [W] | 350 | 315 | 285 | 250 | 250 | 880 | 1500 | 1500 |

TABLE 36-continued

| | Example 16 (layer formation condition 26) | | | | | | | |
|---|---|---|---|---|---|---|---|---|
| | Intermediate layer | | | | | | | Surface layer |
| | A | B | C | D | E | F | G | |
| Temperature of substrate [° C.] | 290 | 290 | 290 | 290 | 290 | 290 | 290 | 290 |
| Layer thickness [nm] | 0 | 80 | 150 | 250 | 450 | 600 | 650 | 500 |

TABLE 37

| | Example 17 (layer formation condition 27) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 315 | 185 | 50 | 50 | 38 | 26 | 26 |
| $H_2$ [mL/min (normal)] | 0 | 0 | 0 | 0 | 0 | 125 | 250 | 250 |
| $CH_4$ [mL/min (normal)] | 0 | 100 | 200 | 300 | 300 | 325 | 350 | 350 |
| Internal pressure [Pa] | 80 | 80 | 85 | 95 | 95 | 90 | 80 | 80 |
| High-frequency power [W] | 350 | 315 | 285 | 250 | 250 | 875 | 1500 | 1500 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 38

| | Example 18 (layer formation condition 28) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 315 | 185 | 50 | 50 | 38 | 26 | 26 |
| $H_2$ [mL/min (normal)] | 0 | 0 | 0 | 0 | 0 | 125 | 250 | 250 |
| $CH_4$ [mL/min (normal)] | 0 | 100 | 200 | 300 | 300 | 350 | 400 | 400 |
| Internal pressure [Pa] | 80 | 80 | 85 | 95 | 95 | 90 | 80 | 80 |
| High-frequency power [W] | 350 | 315 | 285 | 250 | 250 | 730 | 1200 | 1200 |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 39

| | Example 19 (layer formation condition 29) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 315 | 185 | 50 | 50 | 38 | 26 | 26 |
| $H_2$ [mL/min (normal)] | 0 | 0 | 0 | 0 | 0 | 125 | 250 | 250 |
| $CH_4$ [mL/min (normal)] | 0 | 100 | 200 | 300 | 300 | 375 | 450 | 450 |
| Internal pressure [Pa] | 80 | 80 | 85 | 95 | 95 | 90 | 80 | 80 |
| High-frequency power [W] | 350 | 315 | 285 | 250 | 250 | 730 | 1200 | 1200 |

TABLE 39-continued

| | Example 19 (layer formation condition 29) | | | | | | | |
|---|---|---|---|---|---|---|---|---|
| | Intermediate layer | | | | | | | Surface layer |
| | A | B | C | D | E | F | G | |
| Temperature of substrate [° C.] | 290 | 290 | 290 | 290 | 290 | 290 | 290 | 290 |
| Layer thickness [nm] | 0 | 80 | 150 | 250 | 450 | 600 | 700 | 500 |

TABLE 40

| | Example 20 (layer formation condition 30) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 315 | 185 | 50 | 50 | 38 | 26 | 26 |
| $H_2$ [mL/min (normal)] | 0 | 0 | 0 | 0 | 0 | 50 | 100 | 100 |
| $CH_4$ [mL/min (normal)] | 0 | 100 | 200 | 300 | 300 | 450 | 600 | 600 |
| Internal pressure [Pa] | 80 | 80 | 85 | 95 | 95 | 90 | 80 | 80 |
| High-frequency power [W] | 350 | 315 | 285 | 250 | 250 | 730 | 1200 | 1200 |
| Temperature of substrate [° C.] | 290 | 290 | 290 | 290 | 290 | 290 | 290 | 290 |
| Layer thickness [nm] | 0 | 80 | 150 | 250 | 450 | 600 | 650 | 500 |

The electrophotographic photosensitive members described above were evaluated in the same manner as in example 1 and results are shown in Table 41 together with analysis values of the surface layers in the same manner as in examples 1 to 4.

TABLE 41

| | | Ex. 16 | Ex. 17 | Ex. 18 | Ex. 19 | Ex. 20 |
|---|---|---|---|---|---|---|
| | | layer formation condition No. | | | | |
| | | 26 | 27 | 28 | 29 | 30 |
| Surface layer | Si atom density ($\times 10^{22}$ atoms/cm$^3$) | 2.60 | 2.40 | 2.29 | 2.21 | 2.12 |
| | C atom density ($\times 10^{22}$ atoms/cm$^3$) | 4.61 | 4.67 | 4.66 | 4.69 | 4.73 |
| | Si + C atom density ($\times 10^{22}$ atoms/cm$^3$) | 7.21 | 7.07 | 6.95 | 6.90 | 6.85 |
| | C/(Si + C) | 0.64 | 0.66 | 0.67 | 0.68 | 0.69 |
| | H atom density ($\times 10^{22}$ atoms/cm$^3$) | 2.53 | 3.18 | 4.26 | 5.65 | 6.32 |
| | H/(Si + C + H) | 0.26 | 0.31 | 0.38 | 0.45 | 0.48 |
| | $I_D/I_G$ | 0.70 | 0.58 | 0.58 | 0.54 | 0.70 |
| | Layer thickness (nm) | 498 | 499 | 489 | 493 | 495 |
| Intermediate layer | Region A layer thickness (nm) | 272 | 272 | 283 | 287 | 297 |
| | Dot A layer thickness (nm) | | | 69 | | |
| | Dot B layer thickness (nm) | | | 124 | | |
| High-humidity image deletion | | 0.77 | 0.86 | 0.90 | 0.95 | 0.97 |
| Wear resistance | | 0.86 | 0.86 | 0.89 | 0.89 | 1.05 |
| Image blur | | 0.95 | 1.10 | 0.79 | 1.05 | 0.79 |
| Optical sensitivity | | 1.25 | 1.02 | 1.01 | 1.01 | 1.01 |
| Pressure scars | | 1.03 | 1.00 | 1.00 | 1.03 | 1.00 |
| Flaking | | A | A | A | A | A |

Details of the analysis values of the intermediate layer are shown in Table 42.

TABLE 42

| | | Examples 16-20 | | | | | Ex. 16 | Ex. 17 | Ex. 18 | Ex. 19 | Ex. 20 |
|---|---|---|---|---|---|---|---|---|---|---|---|
| | | layer formation condition No. | | | | | | | | | |
| | | Common to 26 to 30 | | | | | 26 | 27 | 28 | 29 | 30 |
| | | Point | | | | | | | | | |
| | | A | B | C | D | E | | | F | | |
| Intermediate layer | Si atom density ($\times 10^{22}$ atoms/cm$^3$) | 4.38 | 3.59 | 3.63 | 2.92 | 2.92 | 2.67 | 2.81 | 2.77 | 2.82 | 2.46 |
| | C atom density ($\times 10^{22}$ atoms/cm$^3$) | 0.00 | 1.46 | 2.13 | 3.16 | 3.16 | 4.18 | 4.04 | 3.98 | 3.90 | 4.19 |
| | Si + C atom density ($\times 10^{22}$ atoms/cm$^3$) | 4.38 | 5.05 | 5.76 | 6.08 | 6.08 | 6.85 | 6.85 | 6.75 | 6.72 | 6.65 |
| | C/(Si + C) | 0.00 | 0.29 | 0.37 | 0.52 | 0.52 | 0.61 | 0.59 | 0.59 | 0.58 | 0.63 |
| | H atom density ($\times 10^{22}$ atoms/cm$^3$) | 1.31 | 1.96 | 2.84 | 4.23 | 4.23 | 3.69 | 3.85 | 4.50 | 5.07 | 5.44 |
| | H/(Si + C + H) | 0.23 | 0.28 | 0.33 | 0.41 | 0.41 | 0.35 | 0.36 | 0.40 | 0.43 | 0.45 |

The more decreases in H/(Si+C+H) under the layer formation conditions in which the flow rate of $H_2$ on the surface layer is higher in Tables 36 to 41 are presumed to be due to desorption effect by hydrogen radicals. As can be seen from the results shown in Tables 41 and 42, the best range for both wear resistance and optical sensitivity is available when H/(Si+C+H) in the surface layer is between 0.30 and 0.45 (both inclusive).

Examples 21 to 24

Electrophotographic photosensitive members were produced in a manner similar to example 1. The formation conditions (layer formation conditions) of the intermediate layer and surface layer are shown in Tables 43 to 46.

TABLE 43

| | Example 21 (layer formation condition 31) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 315 | 185 | 50 | 50 | 38 | 26 | 26 |
| $CH_4$ [mL/min (normal)] | 0 | 100 | 200 | 300 | 300 | 225 | 350 | 150 |
| $C_2H_2$ [mL/min (normal)] | 0 | 0 | 0 | 0 | 0 | 0 | 0 | 0 |
| Internal pressure [Pa] | 80 | 80 | 85 | 95 | 95 | 90 | 70 | 70 |
| High-frequency power [W] | 350 | 315 | 285 | 250 | 250 | 530 | 800 | 800 |
| Temperature of substrate [° C.] | 290 | 290 | 290 | 290 | 290 | 290 | 290 | 290 |
| Layer thickness [nm] | 0 | 80 | 150 | 250 | 450 | 600 | 650 | 500 |

In table 43, the high-frequency power produced pulse of 20 kHz and 50% duty ratio in the RF frequency band.

TABLE 44

| | Example 22 (layer formation condition 32) | | | | | | | |
|---|---|---|---|---|---|---|---|---|
| | Intermediate layer | | | | | | | Surface layer |
| | A | B | C | D | E | F | G | |
| Gas types and flow rates | | | | | | | | |
| $SiH_4$ [mL/min (normal)] | 450 | 315 | 185 | 50 | 50 | 38 | 26 | 26 |
| $CH_4$ [mL/min (normal)] | 0 | 100 | 200 | 300 | 300 | 225 | 150 | 150 |
| $C_2H_2$ [mL/min (normal)] | 0 | 0 | 0 | 0 | 0 | 0 | 0 | 0 |
| Internal pressure [Pa] | 80 | 80 | 85 | 95 | 95 | 90 | 70 | 70 |

TABLE 44-continued

| | Example 22 (layer formation condition 32) | | | | | | | |
|---|---|---|---|---|---|---|---|---|
| | Intermediate layer | | | | | | | Surface |
| | A | B | C | D | E | F | G | layer |
| High-frequency power [W] | 350 | 315 | 285 | 250 | 250 | 530 | 800 | 800 |
| Temperature of substrate [° C.] | 290 | 290 | 290 | 290 | 290 | 290 | 290 | 290 |
| Layer thickness [nm] | 0 | 80 | 150 | 250 | 450 | 600 | 650 | 500 |

TABLE 45

| | Example 23 (layer formation condition 33) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 315 | 185 | 50 | 50 | 38 | 26 | 26 |
| $CH_4$ [mL/min (normal)] | 0 | 100 | 200 | 300 | 300 | 225 | 150 | 150 |
| $C_2H_2$ [mL/min (normal)] | 0 | 0 | 0 | 0 | 0 | 25 | 50 | 50 |
| Internal pressure [Pa] | 80 | 80 | 85 | 95 | 95 | 90 | 70 | 70 |
| High-frequency power [W] | 350 | 315 | 285 | 250 | 250 | 530 | 800 | 800 |
| Temperature of substrate [° C.] | 290 | 290 | 290 | 290 | 290 | 290 | 290 | 290 |
| Layer thickness [nm] | 0 | 80 | 150 | 250 | 450 | 600 | 650 | 500 |

TABLE 46

| | Example 24 (layer formation condition 34) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 315 | 185 | 50 | 50 | 38 | 26 | 26 |
| $CH_4$ [mL/min (normal)] | 0 | 100 | 200 | 300 | 300 | 225 | 150 | 150 |
| $C_2H_2$ [mL/min (normal)] | 0 | 0 | 0 | 0 | 0 | 40 | 80 | 80 |
| Internal pressure [Pa] | 80 | 80 | 85 | 95 | 95 | 90 | 70 | 70 |
| High-frequency power [W] | 350 | 315 | 285 | 250 | 250 | 525 | 800 | 800 |
| Temperature of substrate [° C.] | 290 | 290 | 290 | 290 | 290 | 290 | 290 | 290 |
| Layer thickness [nm] | 0 | 80 | 150 | 250 | 450 | 600 | 650 | 500 |

Example 25

An electrophotographic photosensitive member was produced in a manner similar to example 1. The formation conditions (layer formation conditions) of the intermediate layer and surface layer are shown in Table 47.

TABLE 47

| | Example 25 (layer formation condition 35) | | | | | | | |
|---|---|---|---|---|---|---|---|---|
| | Intermediate layer | | | | | | | Surface |
| | A | B | C | D | E | F | G | layer |
| Gas types and flow rates | | | | | | | | |
| $SiH_4$ [mL/min (normal)] | 450 | 320 | 150 | 50 | 38 | 38 | 26 | 26 |
| $CH_4$ [mL/min (normal)] | 0 | 250 | 560 | 750 | 500 | 600 | 450 | 450 |
| Internal pressure [Pa] | 80 | 80 | 80 | 80 | 80 | 80 | 80 | 80 |
| High-frequency power [W] | 350 | 350 | 350 | 350 | 400 | 600 | 700 | 700 |

TABLE 47-continued

| | Example 25 (layer formation condition 35) | | | | | | | |
|---|---|---|---|---|---|---|---|---|
| | Intermediate layer | | | | | | | Surface layer |
| | A | B | C | D | E | F | G | |
| Temperature of substrate [° C.] | 290 | 290 | 290 | 290 | 290 | 290 | 290 | 290 |
| Layer thickness [nm] | 0 | 80 | 150 | 250 | 450 | 600 | 650 | 500 |

The electrophotographic photosensitive members described above were evaluated in the same manner as in example 1 and results are shown in Table 48 together with analysis values of the surface layers in the same manner as in examples 1 to 4.

TABLE 48

| | | Ex. 21 | Ex. 22 | Ex. 23 | Ex. 24 | Ex. 25 |
|---|---|---|---|---|---|---|
| | | Layer formation condition No. | | | | |
| | | 31 | 32 | 33 | 34 | 35 |
| Surface layer | Si atom density ($\times 10^{22}$ atoms/cm$^3$) | 2.23 | 2.89 | 2.41 | 2.31 | 1.81 |
| | C atom density ($\times 10^{22}$ atoms/cm$^3$) | 5.19 | 4.93 | 5.12 | 5.14 | 4.88 |
| | Si + C atom density ($\times 10^{22}$ atoms/cm$^3$) | 7.42 | 7.82 | 7.53 | 7.45 | 6.69 |
| | C/(Si + C) | 0.70 | 0.63 | 0.68 | 0.69 | 0.73 |
| | H atom density ($\times 10^{22}$ atoms/cm$^3$) | 3.33 | 3.35 | 3.38 | 3.51 | 5.26 |
| | H/(Si + C + H) | 0.31 | 0.30 | 0.31 | 0.32 | 0.44 |
| | $I_D/I_G$ | 0.20 | 0.52 | 0.73 | 0.79 | 0.67 |
| | Layer thickness (nm) | 489 | 491 | 490 | 496 | 498 |
| Intermediate layer | Region A layer thickness (nm) | 252 | 260 | 272 | 268 | 389 |
| | Dot A layer thickness (nm) | 69 | | | | 67 |
| | Dot B layer thickness (nm) | 124 | | | | 186 |
| High-humidity image deletion | | 0.94 | 0.86 | 0.90 | 0.99 | 0.98 |
| Wear resistance | | 0.86 | 0.86 | 0.89 | 1.03 | 0.99 |
| Image blur | | 1.00 | 0.79 | 0.95 | 1.10 | 1.02 |
| Optical sensitivity | | 1.02 | 1.03 | 1.02 | 1.02 | 1.00 |
| Pressure scars | | 1.03 | 1.00 | 1.03 | 1.03 | 0.99 |
| Flaking | | A | A | A | A | A |

Details of the analysis values of the intermediate layer in examples 21 to 24 and in example 25 are shown in Tables 49 and 50, respectively.

TABLE 49

| | | Examples 21-24 | | | | | Ex. 21 | Ex. 22 | Ex. 23 | Ex. 24 |
|---|---|---|---|---|---|---|---|---|---|---|
| | | Layer formation condition No. | | | | | | | | |
| | | Common to 31 to 34 | | | | | 31 | 32 | 33 | 34 |
| | | Point | | | | | | | | |
| | | A | B | C | D | E | F | | | |
| Intermediate layer | Si atom density ($\times 10^{22}$ atoms/cm$^3$) | 4.38 | 3.59 | 3.63 | 2.92 | 2.92 | 3.00 | 2.94 | 2.60 | 2.69 |
| | C atom density ($\times 10^{22}$ atoms/cm$^3$) | 0.00 | 1.46 | 2.13 | 3.16 | 3.16 | 4.15 | 4.07 | 4.25 | 4.21 |
| | Si + C atom density ($\times 10^{22}$ atoms/cm$^3$) | 4.38 | 5.05 | 5.76 | 6.08 | 6.08 | 7.15 | 7.01 | 6.85 | 6.90 |

TABLE 49-continued

| | Examples 21-24 | Ex. 21 | Ex. 22 | Ex. 23 | Ex. 24 |
|---|---|---|---|---|---|
| | Layer formation condition No. | | | | |
| | Common to 31 to 34 | 31 | 32 | 33 | 34 |
| | Point | | | | |
| | A B C D E | F | | | |
| C/(Si + C) | 0.00 0.29 0.37 0.52 0.52 | 0.58 | 0.58 | 0.62 | 0.61 |
| H atom density ($\times 10^{22}$ atoms/cm$^3$) | 1.31 1.96 2.84 4.23 4.23 | 4.20 | 3.94 | 4.02 | 4.05 |
| H/(Si + C + H) | 0.23 0.28 0.33 0.41 0.41 | 0.37 | 0.36 | 0.37 | 0.37 |

TABLE 50

| | | Example 25 Layer formation condition No. 35 Point | | | | | |
|---|---|---|---|---|---|---|---|
| | | A | B | C | D | E | F |
| Intermediate layer | Si atom density ($\times 10^{22}$ atoms/cm$^3$) | 4.38 | 3.43 | 2.86 | 1.76 | 2.08 | 1.88 |
| | C atom density ($\times 10^{22}$ atoms/cm$^3$) | 0.00 | 1.47 | 2.44 | 4.10 | 4.22 | 4.60 |
| | Si + C atom density ($\times 10^{22}$ atoms/cm$^3$) | 4.38 | 4.90 | 5.30 | 5.86 | 6.30 | 6.48 |
| | C/(Si + C) | 0.00 | 0.30 | 0.46 | 0.70 | 0.67 | 0.71 |
| | H atom density ($\times 10^{22}$ atoms/cm$^3$) | 1.31 | 2.20 | 2.98 | 3.91 | 4.20 | 4.89 |
| | H/(Si + C + H) | 0.23 | 0.31 | 0.36 | 0.40 | 0.40 | 0.43 |

As can be seen from Table 48, the best wear resistance is available when the $I_D/I_G$ peak ratio of the surface layer is between 0.20 and 0.70 (both inclusive). Also, as demonstrated by example 25, good characteristics are obtained even if the entire intermediate layer is made a transition layer without providing a region with constant C/(Si+C) or Si+C atom density. As described above, the electrophotographic photosensitive member according to the present invention can both prevent high-humidity image deletion and maintain or improve durability simultaneously at a high level as well as can reduce the risk of pressure scars and flaking.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-269345, filed Nov. 26, 2009, and No. 2010-253635, filed Nov. 12, 2010, which are hereby incorporated by reference herein in their entirety.

What is claimed is:

1. An electrophotographic photosensitive member comprising a photoconductive layer, an intermediate layer made of hydrogenated amorphous silicon carbide on the photoconductive layer, and a surface layer made of hydrogenated amorphous silicon carbide on the intermediate layer, wherein, in the surface layer, a ratio (C/(Si+C); C2) of the number of carbon atoms (C) to a sum of the number of silicon atoms (Si) and the number of carbon atoms (C) is between 0.61 and 0.75, both inclusive, and a sum (D2) of atom density of silicon atoms and atom density of carbon atoms is $6.60\times10^{22}$ atoms/cm$^3$ or more;

in the intermediate layer, a ratio (C/(Si+C); C1) of the number of carbon atoms (C) to a sum of the number of silicon atoms (Si) and the number of carbon atoms (C) as well as a sum (D1) of atom density of silicon atoms and atom density of carbon atoms increase continuously from the side of the photoconductive layer toward the side of the surface layer without exceeding C2 and D2, respectively; and the intermediate layer has a region in which C1 is equal to or larger than 0.25, but not larger than C2, and D1 is between $5.50\times10^{22}$ atoms/cm$^3$ and $6.45\times10^{22}$ atoms/cm$^3$, both inclusive, the region being 150 nm or larger in a layer thickness direction of the intermediate layer.

2. The electrophotographic photosensitive member according to claim 1, wherein the intermediate layer has a continuous region in which C1 is equal to or larger than 0.25, but not larger than C2 and D1 is between $5.50\times10^{22}$ atoms/cm$^3$ and $6.45\times10^{22}$ atoms/cm$^3$, both inclusive, the contiguous region being 150 nm or more in the layer thickness direction of the intermediate layer.

3. The electrophotographic photosensitive member according to claim 1, wherein a ratio (H/(Si+C+H)) of the number of hydrogen atoms (H) to the sum of the number of silicon atoms (Si), the number of carbon atoms (C), and the number of hydrogen atoms (H) in the surface layer is between 0.30 and 0.45, both inclusive.

4. The electrophotographic photosensitive member according to claim 1, wherein the sum (D2) of the atom density of silicon atoms and the atom density of carbon atoms in the surface layer is $6.81\times10^{22}$ atoms/cm$^3$ or more.

5. The electrophotographic photosensitive member according to claim 1, wherein a ratio of a peak intensity $I_D$ of 1390 cm$^{-1}$ to a peak intensity $I_G$ of 1480 cm$^{-1}$ in a Raman spectrum of the surface layer is between 0.20 and 0.70, both inclusive.

6. An electrophotographic apparatus comprising the electrophotographic photosensitive member according to claim 1.

* * * * *